US005703617A

United States Patent [19]

Callahan, Jr. et al.

[11] Patent Number: 5,703,617

[45] Date of Patent: Dec. 30, 1997

[54] SIGNAL DRIVER CIRCUIT FOR LIQUID CRYSTAL DISPLAYS

[75] Inventors: Michael J. Callahan, Jr.; Christopher A. Ludden, both of Austin, Tex.

[73] Assignee: Crystal Semiconductor, Austin, Tex.

[21] Appl. No.: 240,026

[22] Filed: May 9, 1994

Related U.S. Application Data

[63] Continuation-in-part of Ser. No. 138,366, Oct. 18, 1993, Pat. No. 5,574,475.

[51] Int. Cl.[6] ..... G09G 3/36

[52] U.S. Cl. ..... 345/98; 326/105; 345/204

[58] Field of Search ..... 307/205, 463; 345/98, 99, 100, 204; 327/408; 326/105–108

[56] References Cited

U.S. PATENT DOCUMENTS

| | | | |
|---|---|---|---|
| 3,522,420 | 8/1970 | Hartmann et al. | 235/150.52 |
| 3,560,957 | 2/1971 | Miura et al. | 340/347 |
| 4,038,564 | 7/1977 | Hakata | 307/205 |
| 4,180,813 | 12/1979 | Yoneda | 340/784 |
| 4,210,934 | 7/1980 | Kutaragi | 358/241 |
| 4,353,062 | 10/1982 | Lorteije et al. | 340/767 |
| 4,427,978 | 1/1984 | Williams | 340/784 |
| 4,429,305 | 1/1984 | Hosokawa et al. | 340/784 |
| 4,554,539 | 11/1985 | Graves | 340/805 |
| 4,571,584 | 2/1986 | Suzuki | 340/784 |
| 5,099,192 | 3/1992 | Thayer et al. | 323/315 |
| 5,175,446 | 12/1992 | Stewart | 307/463 |
| 5,196,738 | 3/1993 | Takahara et al. | 307/296.1 |
| 5,410,192 | 4/1995 | Yamada | 327/408 |

FOREIGN PATENT DOCUMENTS

| | | |
|---|---|---|
| 0071911A2 | 7/1982 | European Pat. Off. . |
| 0391655A2 | 4/1990 | European Pat. Off. . |
| 0478386A2 | 9/1991 | European Pat. Off. . |
| 0488516A2 | 10/1991 | European Pat. Off. . |
| 0515191A2 | 5/1992 | European Pat. Off. . |
| 0526713A2 | 6/1992 | European Pat. Off. . |

OTHER PUBLICATIONS

Bakoglu, "Circuits, Interconnections, and Packaging for VLSI," *Interconnection Capacitance*, Chapter 4, 156–169, 1990.

Heller and Griffin, "Custom and Semi–Custom Design Techniques," *Digest of Technical Papers*, 16–17, 1984.

S. Terazawa and H. Yamaguchi, "Driving Method for TFT/LCD Grayscale," *IBM Technical Disclosure Bulletin*, vol. 33 No. 6B, 384–385, Nov. 1990.

"Development of a Low Voltage Source Driver for Large TFT–LCD System for Computer Applications", *Conference Record of the 1991 International Display Research Conference*, pp. 111–114 (Oct. 15, 1991).

*Primary Examiner*—Steven Saras

*Attorney, Agent, or Firm*—Richard D. Egan; J. P. Violette

[57] ABSTRACT

The present invention relates to a signal driver circuit for driving a liquid crystal display panel. The signal driver circuit provides level shifting within the circuit to lower the power consumption of a liquid crystal display module while still providing a wide analog voltage range to the liquid crystal display elements. The decoding circuits utilize a strand of abutting decode input transistors which are connected in series. Further to reduce the physical size of the decoding circuits, multiple decode circuits may share circuitry that decodes the most significant bits of a data word. A cell layout is utilized such that the most significant bits data are bused into the cell through metal lines and the least significant bits are bused in polysilicon that also operates as the gate of the decode input transistors. Moreover, the decode cell input transistors may all be of the same conductivity type.

21 Claims, 28 Drawing Sheets

| DECIMAL | BINARY | | | | | |
|---|---|---|---|---|---|---|
| | a | b | c | d | e | f |
| 0 | 0 | 0 | 0 | 0 | 0 | 0 |
| 1 | 0 | 0 | 0 | 0 | 0 | 1 |
| 2 | 0 | 0 | 0 | 0 | 1 | 0 |
| 3 | 0 | 0 | 0 | 0 | 1 | 1 |
| 4 | 0 | 0 | 0 | 1 | 0 | 0 |
| 5 | 0 | 0 | 0 | 1 | 0 | 1 |
| 6 | 0 | 0 | 0 | 1 | 1 | 0 |
| 7 | 0 | 0 | 0 | 1 | 1 | 1 |

FIG. 9F

SIGNAL DRIVER CIRCUIT FOR LIQUID CRYSTAL DISPLAYS

This is a continuation-in-part application of patent application Ser. No. 08/138,366, filed Oct. 18, 1993, now U.S. Pat. No. 5,574,475.

A portion of the disclosure of this patent document contains material which is subject to mask work protection. The mask work owner has no objection to the facsimile reproduction by any one of the patent disclosure, as it appears in the Patent and Trademark Office patent files or records, but otherwise reserves all mask work rights whatsoever.

BACKGROUND OF THE INVENTION

This invention relates to a signal driver circuit for a liquid crystal display ("LCD"), and more particularly, to a digital-in/analog-out signal driver circuit for controlling the gray levels of LCD pixels in LCD column driving applications.

Signal driver circuits are commonly employed with liquid crystal displays. The driver circuit typically accepts digital video data as an input and provides an analog voltage output to each particular LCD pixel column. Generally, each column in the LCD must be uniquely addressed by a signal or column driver and given the proper analog voltage in order to achieve the desired transmissivity (i.e., the desired shade of gray or color). Moreover, it is desirable that the output voltage range of a driver circuit be wide to allow for a high pixel contrast ratio.

For color LCDs, each pixel is composed of 3 sub-pixel elements representing the primary colors of red, green and blue. For example, a color VGA panel having a resolution of 640 columns×480 rows of uniquely addressable pixels will have 3×640 columns, or 1,920 columns. Typically, the signal driver circuit has one driver output for each column. Thus controlling an LCD panel requires a large number of driver outputs that consume considerable circuit area. Since circuitry size impacts the costs of a signal driver, it is desirable to reduce the size of signal drivers.

As LCD panel technology has improved, it has become desirable to render images with more continuous gray scales or to have more unique colors available. The voltage control required from signal drivers has, therefore, become more complex. However, it is also desirable to reduce the cost of a driver circuit by decreasing the physical size of the signal driver and desirable to reduce the amount of power dissipated by the driver circuit. Therefore, it is desirable to have a signal driver which balances the need for more discrete analog voltage levels while consuming less area and dissipating less power.

SUMMARY OF THE INVENTION

The present invention satisfies the above-noted desires by providing a signal driver for a liquid crystal display capable of producing a great number of discrete analog voltage levels, while dissipating less power, and consuming less chip area.

Signal driver area is reduced by use of a unique decoder cell design, and power dissipation is minimized, without sacrificing control over the transmissivity of the LCD, by level shifting the signal driver operating voltage. Thus, an LCD module and signal driver may operate at lower voltages than the required signal driver output voltages.

The decoder cell utilizes data input bus lines that also serve as decoder input transistor gates. These gates may be connected in series and used with a latch and reset circuit. The most significant bits of a decode state may be decoded by input transistors that are shared by more than one decode cell. Each decode cell may also have unique input transistors that decode the least significant bit of a decode state.

In one embodiment of the present invention, level shifting is incorporated. In order to level shift, a signal driving circuit for driving an LCD panel includes a plurality of data inputs at a first voltage level, a plurality of driver outputs to the LCD panel that may operate at a second voltage which may be higher than the first voltage, and a voltage level shifter within the signal driver circuit connected to each decoder cell for shifting voltage levels. The decoder cell may include a latch and reset circuit. Further, the decoder cell may include most significant input transistors and least significant input transistors, with at least two decoder cells sharing the same most significant input transistors.

In yet another embodiment of the present invention, a method of level shifting the voltage level within an LCD signal driver is contemplated including the steps of providing input data at a first voltage level, busing a decode state at the first voltage level, decoding the decode state within a decoder cell and level shifting a voltage level of the decoder output to a second voltage level having a magnitude higher than the first voltage level. The method may also include latching the decode state into the decoder cell and resetting the decoder cell to bring the decoder cell to a reset state. Further, the method may include decoding most significant bits of the decode state, decoding least significant bits of the decode state, and utilizing a most significant bit decoder within the decode cell to decode a portion of a plurality of decoder states.

In another embodiment of the present invention, a decoder cell within an LCD driver for selecting one of a plurality of voltages for application to an LCD driver is provided. The decoder cell includes a plurality of first data input lines forming a plurality of first transistor gates. The data input lines cross active regions of the cell to form the first transistors. Further, the data input lines provide data input to at least one other decoder cell. A plurality of second data input lines is connected to a plurality of second transistor gates and the second data input lines also provide data to at least one other decoder cell. The first and second transistors may form a portion of a latch circuit. The first transistors may also form the least significant input transistors and the second transistors may form the most significant bits input transistors. The most significant input bit transistors may be shared with other decoder cells.

In yet another embodiment of the present invention, a decoder cell within an LCD driver is contemplated in which the decoder cell includes a plurality of data input lines, a latch circuit connected to the data input line, and a reset circuit connected to the latch circuit. The latch circuit may hold a decode state of the decoder cell and the reset circuit resets the latch circuit. The latch circuit may include a plurality of first transistors connected in series. The latch circuit may also include a plurality of second transistors, at least one of the second transistors connected in series with the first transistors and a gate of at least one of the second transistors connected to a node between the series of first transistors and the at least one second transistor.

Also disclosed is a decoder circuit within an LCD signal driver circuit for selecting a decode state corresponding to a voltage to be applied to an output of the signal driver circuit. The decoder circuit includes a plurality of generally parallel data bus lines carrying a digital number representing a desired output voltage of the signal driver circuit and extending through the signal driver circuit to at least one adjacent decoder circuit. The data bus lines include most significant bit data bus lines and least significant bit data bus lines. A plurality of most significant bit transistors have gates connected to the most significant bit data bus lines. The most significant bit transistors form an abutting strand of transistors in an active area which is connected to a plurality of least significant bit transistors. The most significant bit transistors are connected to the plurality of least significant bit transistors so that each most significant bit transistor is used to decode at least two decode states. Further, the least significant bit data bus lines may selectively cross the active area to form the least significant bit transistors.

The present invention also include a method for decoding a plurality of unique decode states including the steps of providing a digital decode state to a decode circuit, decoding the most significant bits with a most significant bit decoder within the decode circuit, decoding least significant bits with a plurality of least significant bit decoders within the decode circuit, and utilizing the most significant bit decoder to decode a plurality of decoder states. In another method of decoding unique decode states corresponding to voltage levels of an output of an LCD signal driver, the steps include providing a decode state to a decoder cell, decoding the decode state with a latch circuit that selectively latches in response to on unique decode state and resetting the latch circuit with a reset circuit.

BRIEF DESCRIPTION OF THE DRAWINGS

FIG. 9F is a table showing the shared MSB bits for various decoders 0 through 7.

DETAILED DESCRIPTION

Figure 1:
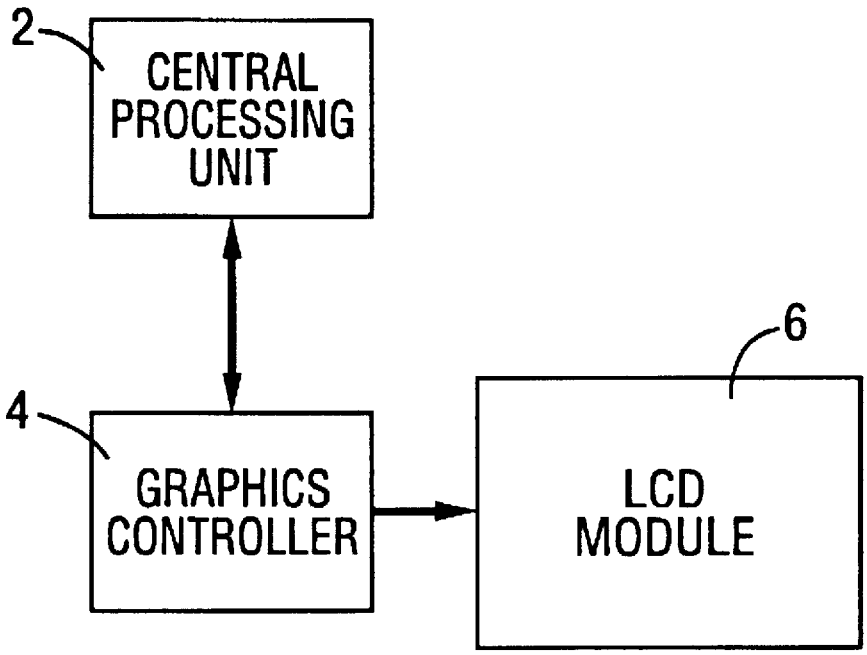
FIG. 1 shows an operating environment for a liquid crystal display module.

FIG. 1 illustrates a typical LCD application. Generally, a central processing unit 2 interacts with a graphics controller 4 which then provides digital data to an LCD module 6 in order to visually display data for a user.

Figure 2:
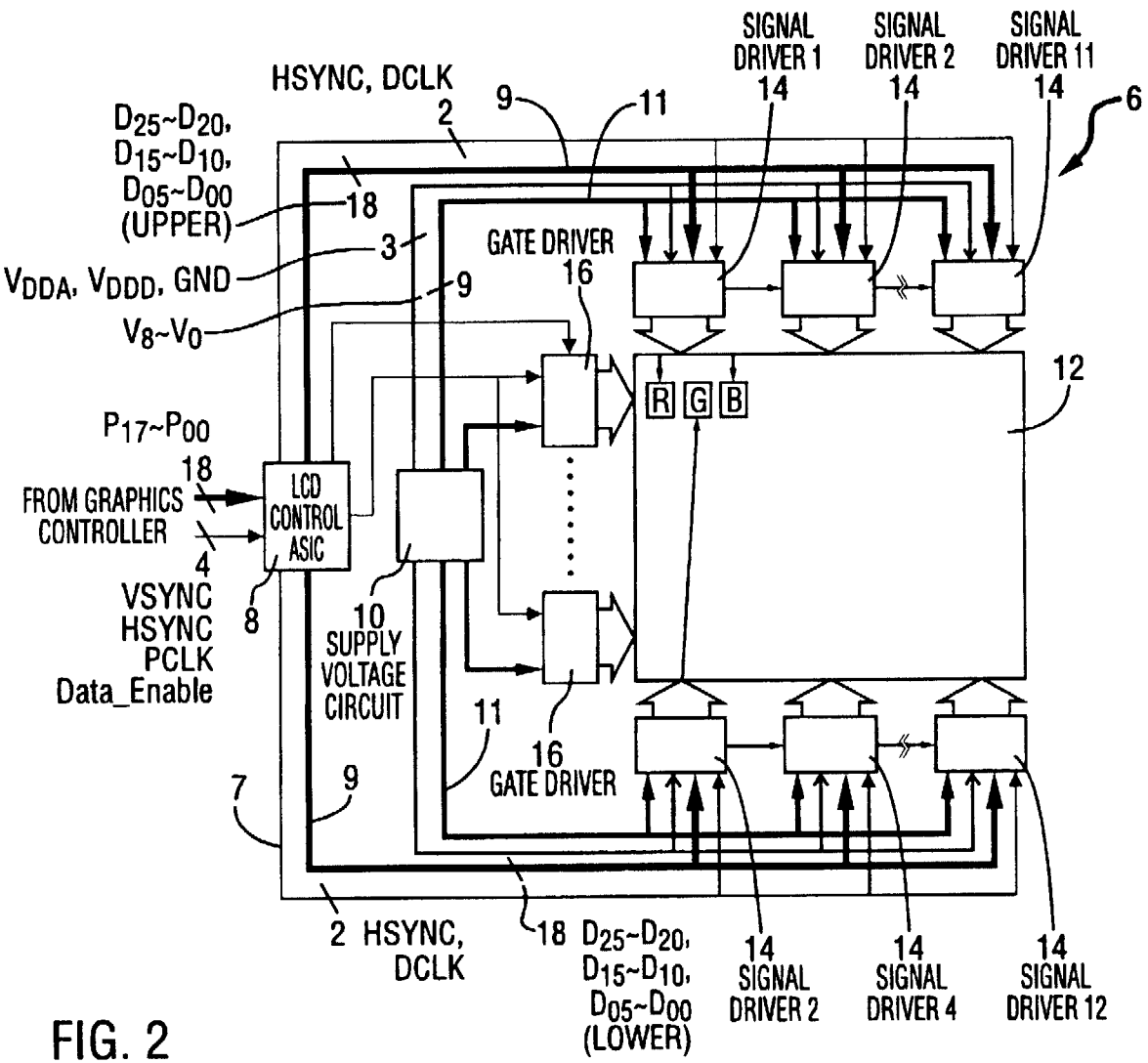
FIG. 2 is a block diagram of the circuitry within the liquid crystal display module.

FIG. 2 is an overview of the circuitry typically contained within LCD module 6. For example, LCD module 6 may contain an LCD control ASIC 8, a voltage supply circuit 10 and color LCD panel 12. LCD panel 12 may be, for example, a thin-film transistor LCD ("TFT-LCD"). LCD panel 12 is generally driven by column and row drivers. For example, columns may be driven by signal drivers 14 and rows driven by gate drivers 16. Generally, signal drivers 14 receive digital video data from LCD control ASIC 8 via bus 9, control signals via bus 7 and analog supply voltages from supply voltage circuit 10 via bus 11. The present invention is not limited, though, to the specific LCD module shown in FIG. 2.

Signal drivers 14 provide an analog voltage output signal to each column. Furthermore, signal drivers 14 provide a varying analog output voltage such that a desired gray scale may be obtained for the pixels within LCD panel 12. Generally, a plurality of signal driver units are used to drive the columns of an LCD panel. For example, an LCD panel having 1,920 columns may be driven by 10 signal drivers 14 if each signal driver 14 is capable of driving 192 columns or more.

Figure 3:
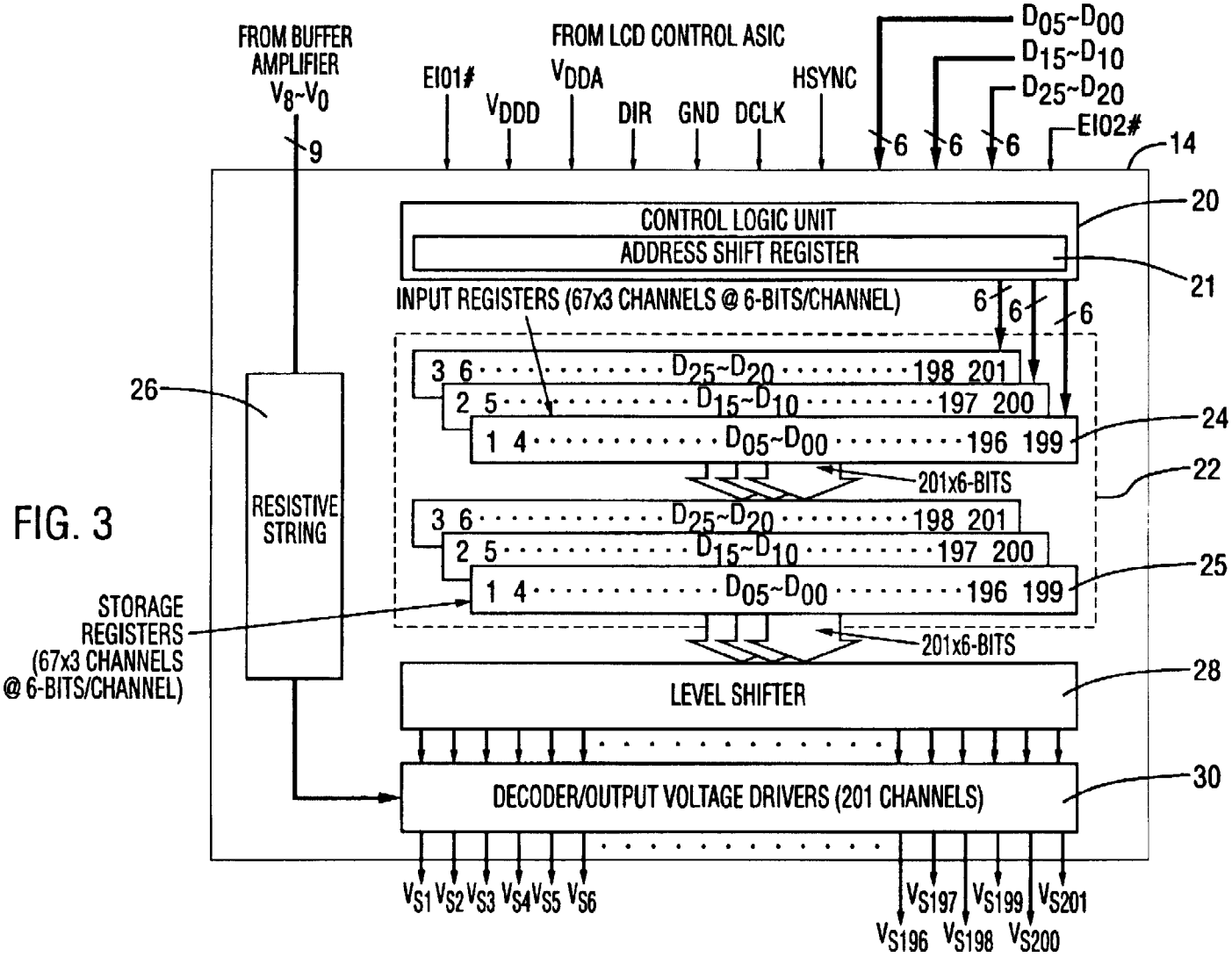
FIG. 3 is a block diagram of the circuitry within an embodiment of a signal driver according to the present invention.

FIG. 3 shows an overview of a driver circuit embodiment of the present invention. Each channel of each signal driver 14 (also called a source, data or column driver) generates and outputs a highly accurate analog voltage to LCD 12. The output voltage level is based upon the corresponding subpixel data from the graphics controller 4. A channel refers to a signal driver output (or physical LCD pixel) and its associated circuitry. For LCDs with color filters, a channel corresponds to a sub-pixel—red, green or blue. For monochrome LCDs, a channel corresponds to a pixel.

The block diagram in FIG. 3 shows the internal architecture of signal driver 14, which comprises seven major sections: control logic unit 20; address shift register 21; data registers 22 including input registers 24 and storage registers 25; resistor string 26; level shifters 28; and decoder/output voltage drivers 30.

The control logic unit 20 coordinates the signal drivers input and output functions, generates internal timing signals, and provides an automatic standby mode. During the standby mode, the majority of the internal circuitry of signal driver 14 is powered down to minimize power dissipation.

The address shift register 21 contains an N-bit shift register, where N is the number of uniquely addressable channels within signal driver 14. The direction of shift of shift register 21 is determined by the logical state of the DIR pin. The shift register 21 is clocked with the DCLK.

In a first embodiment of signal driver 14, there are 201 input registers 24, each comprising three sets of 67 latch circuits which latch 201 six-bit words of input display data. In a second embodiment, there are 192 input registers 24, each comprising three sets of 64 latch circuits which latch 192 six-bit words of display data. Each latch circuit contains three six-bit planes, where each plane corresponds to the significance of the input display data. (Note: $D_{15}$ is the most significant bit (MSB) and $D_{10}$ is the least significant bit (LSB)).

In first embodiment, storage registers 25 store 201 channels of six-bit display data for one line period (192 channels of six-bit data for the second embodiment), enabling the decoder 30 to use the display data from line time x while the next line of data (from line time x+1) is loaded into the input registers 24. The contents of the storage registers 25 are over-written with the next line of 201 (or 192) six-bit words of display data from the input registers 24 after a low-to-high transition occurs on HSYNC at the end of line time x+1.

An internal resistor string 26 used for voltage dividing, which may comprise a string of 64 resistors, produces 64 distinct voltage levels from the 9 voltage reference inputs ($V_0$–$V_8$). Linear voltage levels are generated between each pair of adjacent reference voltage inputs, utilizing a string of 8 resistors between the reference voltages.

Decoder 30 selects the desired output voltage based upon the data in the storage register 25 for each of the 201 (or 192) channels. As the display data for line x+1 is loaded into the input registers 24, the decoder 30 uses the data for line x stored in the storage registers 25.

Each of the output voltage drivers 30 outputs one of 64 analog voltages based upon the corresponding decode of the display data. The first embodiment contains 201 output voltage drivers 30, the second embodiment has 192. The analog voltage outputs are simultaneously applied from all channels of all signal drivers to the current row on the LCD 12 when a low-to-high transition occurs on HSYNC.

As seen in FIGS. 2 and 3, the graphics controller 4 outputs three channels of pixel data $P_{17}$~$P_{00}$ (six-bits per channel for a total of eighteen-bits) in parallel along with the horizontal sync (HSYNC), vertical sync (VSYNC), pixel clock (PCLK) and data enable (Data_Enable) signals to a Control ASIC 8 in the LCD module 6. The LCD control ASIC 8 re-formats the pixel data and outputs three channels of data in parallel to each signal driver 14.

The present invention supports a variety of LCD pixel resolutions, Simulscan™ of CRT and LCD displays and various frame frequencies. Additionally, the invention may be used in a single bank or dual bank configuration to drive the LCD's channels (pixels).

The LCD control ASIC 8 outputs three six-bit words in parallel (eighteen-bits—six-bits each for the Red, Green and Blue sub-pixels) to each bank of signal drivers 14. If two banks of signal drivers 14 are used (as shown in FIG. 2), the LCD control ASIC 8 divides the input data into separate data streams for each bank, such that the data rate is one-half the input pixel data rate. If a single bank of signal drivers 14 is used, the data rate is equal to the input pixel data rate. The LCD control ASIC 8 generates and outputs the HSYNC and DCLK signals to the signal drivers 14.

Signal driver 14 receives the following signals as inputs: Enable In/Out (EI01# and EI02#) signals; data shift direction control (DIR) signal; Data Clock (DCLK); Data ($D_{25}$~$D_{20}$, $D_{15}$~$D_{10}$, $D_{05}$~$D_{00}$); and Horizontal Sync (HSYNC) signal.

The Enable Input/Output signals (EI01# and EI02#) provide two functions. First EI01# and EI02# "enables" the signal driver 14. The signal driver 14 is normally in a low power standby mode and is activated by the high-to-low transition of the EI0x# (Enable In) input. After the high-to-low transition on EI0x# is detected (and the standby mode is exited), the signal begins to latch the input data. Second, EI01# and EI02# allows the currently active signal driver 14 to enable the next signal driver 14 by driving the EI0x (Enable Out) output low, once 201 (or 192) data words are latched.

The shift direction of the signal driver 14 is controlled by the status of the DIR input signal. The DIR signal provides the signal driver 14 with the flexibility for the display data to be input from either channel 1 to channel 201 (or 192) or from channel 201 (or 192) to channel 1.

When the DIR signal is tied to $V_{DDD}$ (DIR=1), display data input is enabled by a low-going signal on the EI02# input. Three channels of data (eighteen-bits) are input into the driver 14 on the falling edge of every DCLK. After the display data for all channels are latched into the input registers 24, the signal driver 14 automatically enters a low-power standby mode, and the EI01# signal is driven low on the falling edge of the $67^{th}$ (or $64^{th}$) DCLK. The EI01# signal is reset to the inactive state (high) with the next low-to-high transition of the HSYNC signal.

Each of the 201 (or 192) channels' output voltage is simultaneously output to the LCD 12 on the HSYNC rising edge. The voltage level decoded by the first data word of display data is output from pin $V_{S201}$ (or $V_{S192}$), and the level decoded by the last word of display data is output on pin $V_{S1}$.

When the DIR signal is tied to GND (DIR=0), display data input is enabled by a low-going signal on the EI01# input. After the display data for 201 (or 192) channels are latched into the input registers, the signal driver 14 automatically enters a low-power standby mode and the EI02# signal is driven low on the falling edge of the $67^{th}$ (or b $64^{th}$) DCLK. The EI02# signal is reset to the inactive state (high) with the next low-to-high transition of the HSYNC signal. The output voltage level selected by the first data word of display data is output from pin $V_{S1}$, and the level selected by last word of display data is output on pin $V_{S201}$ (or $V_{S192}$).

The signal driver 14 samples the data signals on the falling edge of the DCLK signal. The LCD control ASIC 8 must shut down the DCLK during the HSYNC active period.

Each time the signal driver 14 is enabled (EI0x#, Enable In, is low), three six-bit words Data ($D_{25}$~$D_{20}$, $D_{15}$~$D_{10}$, $D_{05}$~$D_{00}$) of display data for three channels are latched in parallel into the input registers 24 on the falling edge of DCLK. After 67 (or 64) transitions of the DCLK, data for all 201 (or 192) channels (3×67 or 3×64) have been input. After the $67^{th}$ (or $64^{th}$) DCLK pulse, the signal driver 14 returns to the standby mode to minimize power consumption.

Each low-to-high transition on HSYNC causes the following. The contents of the 201 (or 192) input registers 24 are transferred to the storage registers 25, enabling the input registers 24 to be filled with the next line of display data during the next line time. The output voltage drivers 30 update the output voltage to the LCD 12 simultaneously for all 201 (or 192) channels. The EI01# or EI02# signals are reset to inactive (high) state.

The Enable Out pin is driven low with the falling edge of the $67^{th}$ (or $64^{th}$) DCLK. The Enable Out may be connected to an adjacent signal driver Enable In pin such that subsequent data may be loaded in the adjacent drivers 14. The EI01# input to the first signal driver 14 is grounded. This means that the first signal driver 14 latches the display data on the falling edge of the first available clock. The system implementation should ensure that the data clock (DCLK) input is gated with the Display_Enable signal so that data is valid with the first available DCLK. After the $67^{th}$ (or $64^{th}$) DCLK pulse, the signal driver 14 returns to the standby mode to minimize power consumption.

Each output voltage driver 30 generates a number of precise analog voltages (for example, 64). Each output voltage driver 30 begins to output one of a number of voltages to the LCD panel 12 simultaneously for all 201 (or 192) channels after the rising edge of HSYNC.

The decoder 30 selects the desired output voltage level based upon the data in the storage register 25 for each of the 201 (or 192) channels.

An internal resistive DAC 26, which may comprise a string of 64 resistors, produces linear voltage levels between any pair of adjacent reference voltages.

The supply voltage circuit 10 shown in FIG. 2 generate all the voltages required by the LCD panel 12. Signal driver 14 requires the following power supplies and reference voltages: one digital supply voltage ($V_{DDD}$); one analog supply voltage ($V_{DDA}$); nine reference voltages ($V_8$–$V_0$).

Figure 3A:
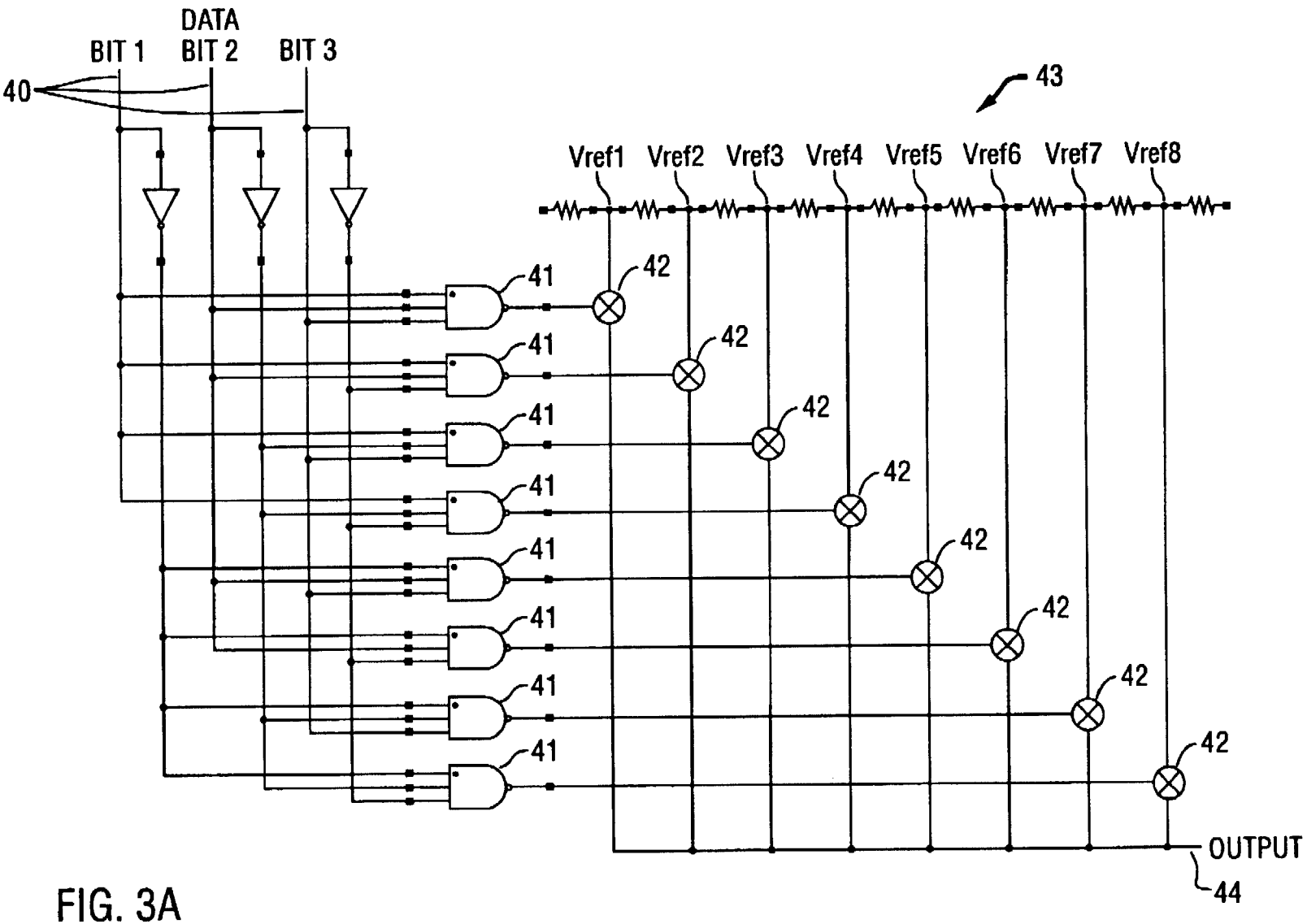
FIG. 3A is a functional schematic of a decoder circuit for a signal driver according to the present invention.

Signal driver circuit 14 shown in FIG. 3 provides up to sixty-four voltage levels on each of two hundred one LCD columns. It will be recognized, though, that more or less voltages or columns may be utilized. Within signal driver 14, decoder/output voltage drivers 30 are used to provide a specific voltage output to each column. The interaction between decoder/output voltage drivers 30 and resistive string 26 may be seen more clearly in FIG. 3A. FIG. 3A functionally illustrates a decoder circuit for one column and full digital decoder architecture that may be utilized by the decoder. For illustrative purposes, FIG. 3A presents only eight voltage levels. Thus, three data bits are needed to select the eight voltage levels. It is recognized that any number of voltage levels may be selected, for example, signal driver 14 may utilize sixty-four voltage levels which would require six data bits to select the desired levels. In general, $2^N$ voltage levels may be used, where N is the number of data bits.

In FIG. 3A, digital data bit lines 40 and their compliments are supplied to a series of NAND gates 41. Each NAND gate 41 is connected to select one of the eight possible digital states. Connected to NAND gates 41 are analog switches 42. Analog switches 42 are also connected to resistive string 43. One analog switch 42 is provided for each desired voltage output, for example, as shown in FIG. 3A, eight switches 42 are for eight possible voltage outputs. Thus, the circuit shown in FIG. 3A uses full digital decoding logic to convert digital data on data bit lines 40 to an analog voltage output 44. Though not shown in FIG. 3A, switches 42 may utilize both the output of NAND gates 41 and the inverted output of NAND gates 41.

Figure 3B:
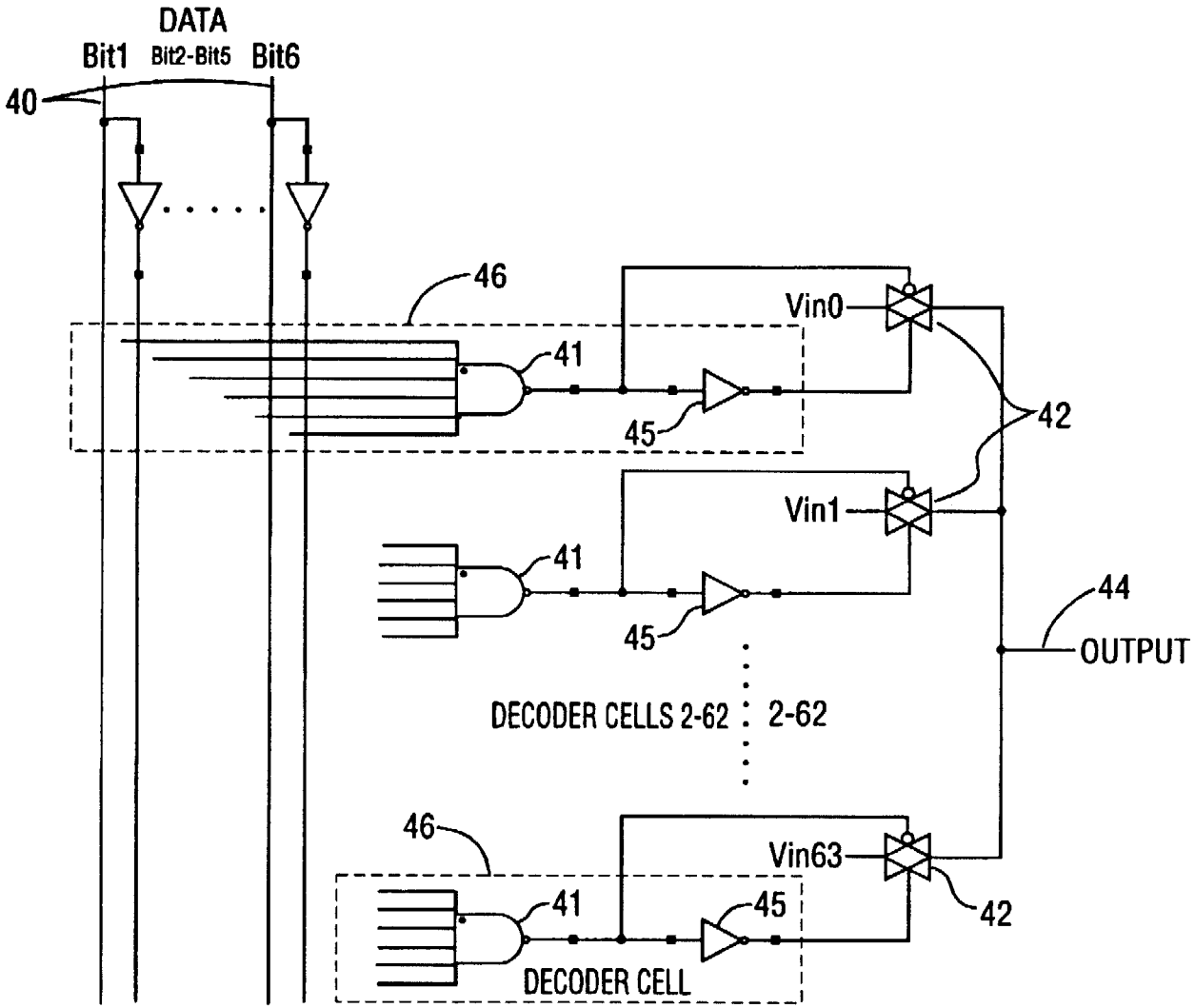
FIG. 3B is a schematic of decoder logic utilized in the present invention.

FIG. 3B is the full digital decoder logic used to select one of the sixty-four analog output voltages $V_{in0}$–$V_{in63}$. Sixty-four NAND gates 41 are connected to six-bit lines 40, each NAND gate 41 being connected to select one of the sixty-four possible digital states. The inverted output of each NAND gate 41 is also provided to switch 42 as shown in FIG. 3B. As shown in FIG. 3B, inverter 45 and NAND gate 41 may be together considered decoder cell 46. Thus, for sixty-four possible analog outputs, sixty-four decoder cells (cells 0–63), sixty-four analog switches and sixty-four analog voltages are used. It will be recognized, though, that as used herein a decoder cell may also include switch 42. In general, a cell is simply a repeated structure used to decode a specific decode state to provide a voltage to an output of the signal driver.

As with reference to FIGS. 3A and 3B and as discussed above, resistor strings or resistor voltage dividers may by used for supplying the voltage levels that may be switched to a column output. In one embodiment of the present invention, sixty-four different voltage levels are utilized by placing in series eight resistors between each of nine voltage reference voltages supplied to the signal driver chip bonding pads. This arrangement serves to provide a plurality of analog voltages to generate a digital code-output voltage curve that is tailored to match the non-linear characteristics of a particular LCD panel's transmissivity-voltage response. The use of nine voltage references allows for an eight segment piecewise-linear approximation of the desired code-voltage response. Voltage references $V_0$ and $V_8$ define the extremes that the driver can provide while reference voltages $V_1$–$V_7$ define the shape of the curve between $V_0$ and $V_8$ in a piecewise-linear fashion. Thus, the approach of this resistor string digital to analog converter (DAC) architecture requires at least 64 individual resistors of moderate electrical value (of approximately 40 ohms each in one embodiment). In order to prevent metal resistance from causing noticeable and undesirable errors, the total metal resistance from bonding pad to the resistor string must be small compared to the smallest resistor segment corresponding to one least significant bit of the DAC (40 ohms). If the desire code-voltage curve was linear there would ideally be no DC current supplied from $V_1$–$V_7$ while $V_0$ and $V_8$ would be required to source/sink the entire current of the resistor string such that it is most important to reduce the metal resistance from the pad to the string $V_0$ and $V_8$. As $V_1$–$V_7$ are deviated from the linear case, they must source or sink a "difference" current required to change the shape of the curve while $V_0$ and $V_8$ supply the remainder of the string current. Therefore, it is also important to minimize the metal resistance for the other references as well. Because signal driver chips may be long, the metal runs themselves may have significant resistance. For example, a minimum width run of metal from one end of the chip the other could be as much as 700 to 800 ohms.

To place the 64 resistors near one end of the chip would result in long metal runs from the reference bonding pads to the resistors and/or from the resistor strings to decoder cells and possibly unacceptably high resistance. Furthermore, the resistance from each of the nine references should be equal, or at least bounded by some reasonable maximum range, in order to satisfy typical accuracy requirements. In addition, too much metal resistance from the resistors to any output can create different delays from one channel to another, creating visual banding.

It is therefore desirable to place the resistors strings such that long metal runs from the reference pads to the resistors, or from the resistors to the outputs, or both are avoided. Placing a single resistor string in the middle of the circuit keeps the dc resistance error term reasonably small, and by placing the reference pads across the top of the chip and symmetrical about the center line, minimization of dc resistance from metal is readily achieved. However, the metal line from the resistor string in the center of the chip to decoder cells near the ends of the chip may have resistance which could approach 350–400 ohms, which would cause some outputs to have different ac performance which could be noticeable.

Therefore, the present invention utilizes distributed resistors having two parallel resistor strings placed such that the maximum distance from any decoder cell to a resistor string is equalized across the chip. Thus, dc resistances may be minimized as well as differences between the ac settling characteristics from channel to channel. The worst-case metal resistance from any resistor to any output is ¼ of the metal resistance from end to end of the circuit. In addition, by placing the reference pads symmetrically with the vertical center line of the chip, it is possible to minimize and equalize the metal resistance of each reference from pad to resistor. It will be recognized that if three resistor strings are used, the worst case distance will be ⅙, if four strings are used, ⅛, etc.

One additional way to prevent different metal resistances from resistors to pads is by folding the resistor string into a U-shape structure, which allows both the bottom and the top connections to each resistor string to be made near the top of the chip, which allows the minimum metal distance between pad and resistor. For example with reference to a 9 reference voltage embodiment, while there are 9 total references, the two most sensitive to metal resistance are the top and bottom connections, because these carry the most current. In spite of these low resistance connections for two of the reference levels, there are an additional seven references which traverse different distances from pads to resistors. In order to maintain a worst-case small time constant with the folded resistor arrangement described above, the horizontal metal busses to distribute the reference potentials to resistors need to be as wide as possible to keep their resistance low. In order to keep die size as small as possible, each reference line is only made as wide as necessary to keep the overall worst-case metal resistance at a minimum. This results in metal busses for different references which are of different widths. This results in minimum time constant with a minimum of die area expanded.

Figure 3C:
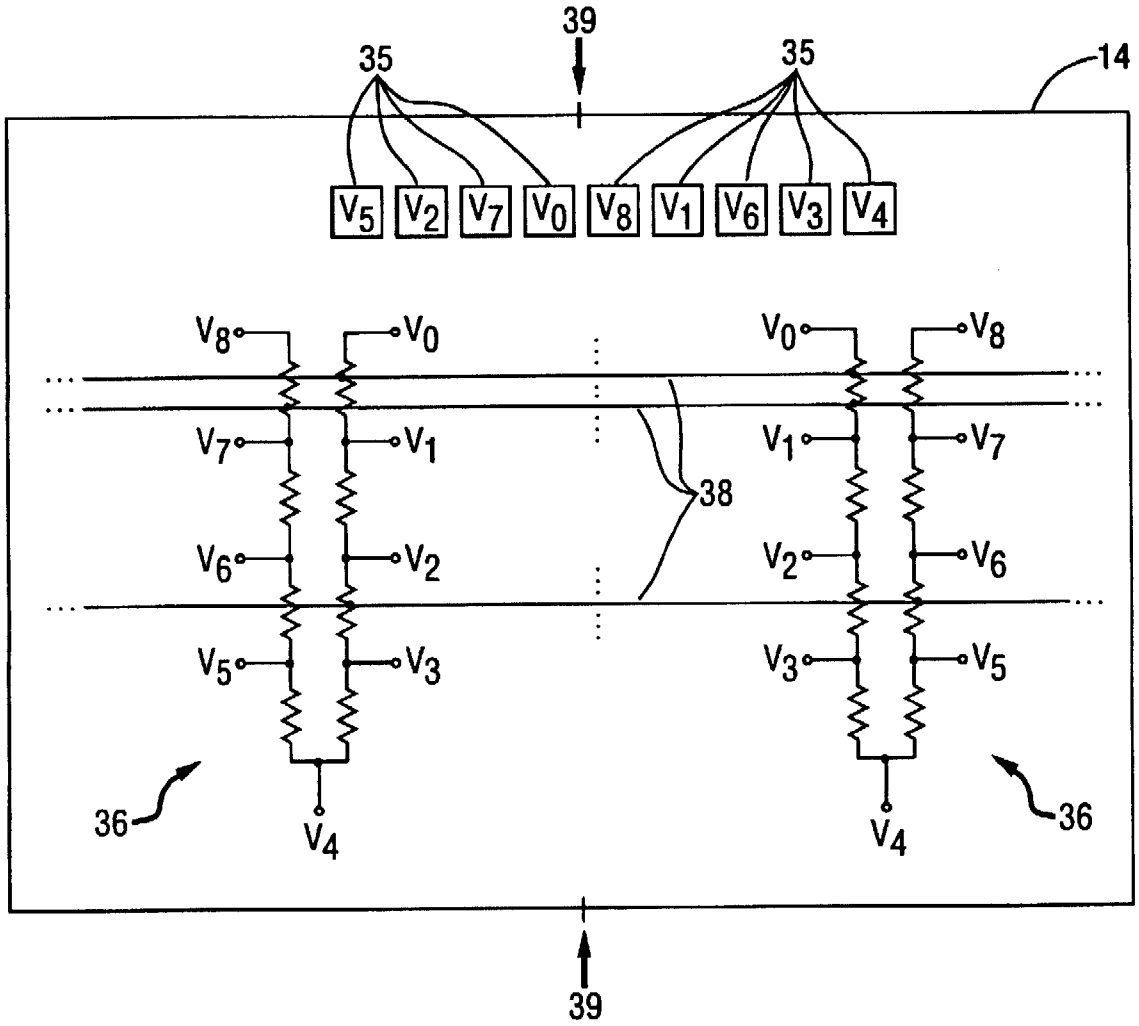
FIG. 3C is a block diagram of a signal driver chip having distributed resistor strings.

Though not shown to scale, a signal driver circuit using resistor strings or voltage dividers according to the principles discussed above is shown generally in FIGS. 3C and 3D. In FIG. 3C, signal driver chip 14 has nine reference voltage bond pads 35 for reference voltages $V_0$–$V_8$ centered about midpoint 39. Two U-shaped resistor strings 36 are provided at locations approximately ¼ and ¾ across the length of the chip. Columns of decoding cells and switches (not shown) are formed between resistor strings 36 and between each resistor string 36 and the ends of signal driver circuit 14. If 3 strings are utilized, the strings should be spaced equally such that the distance between adjacent strings is ⅓ the circuit length. Four strings would be spaced ¼ the circuit length, and so on. Therefore, preferably adjacent strings are spaced approximately 1/n the circuit length when n is the length of the circuit and the distance between the strings on either end of the circuit and the edge of the circuit is ½n.

Each resistor string 36 has voltage inputs $V_0$–$V_8$ which are tied together to the respective reference voltage bond pads (not shown). Thus, parallel resistor strings are created. As shown in 3D, between any two adjacent resistor string voltage inputs, eight small resistors 37 are formed. Sixty-four conductors 38 connect the respective nodes of resistor strings 36 and provide a voltage input $V_{in}$ for each column of decoder cells across the chip.

FIG. 3C illustrates the electrical schematic of the resistor string. It will be recognized that the physical layout may take many forms. For example, as shown in FIG. 3E resistors 37 of a resistor string 36 may be interwoven. FIG. 3E shows such an interwoven layout for the portion of a resistor string 36 adjacent to $V_0$ and $V_8$. The remainder of the string may be similarly arranged.

Figure 3D:
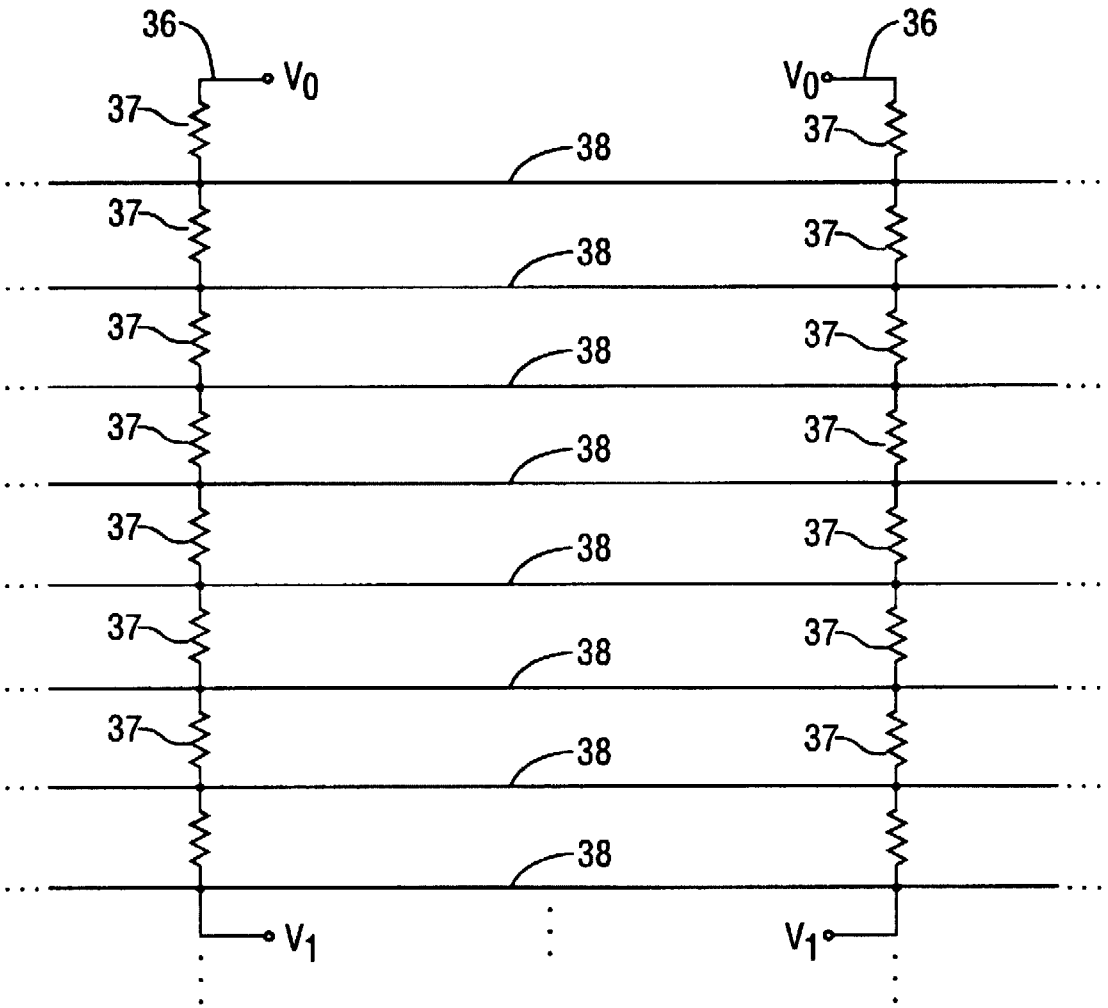
FIG. 3D is a schematic of a portion of the resistor strings shown in FIG. 3C.
Figure 3E:
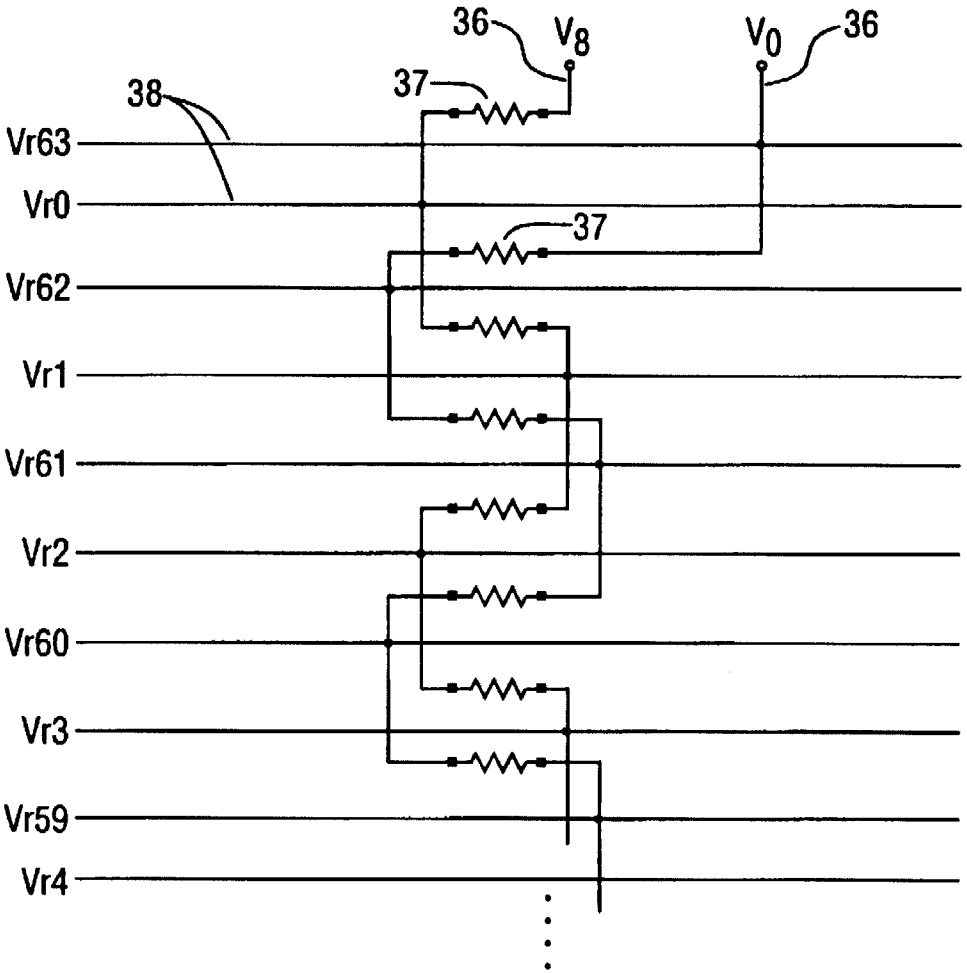
FIG. 3E is an embodiment of the layout of a resistor string shown in FIG. 3C.

As mentioned above, the two most sensitive portions of the resistor strings are the top and bottom (such as between $V_0$ and $V_1$, and between $V_7$ and $V_8$ in FIGS. 3C and 3D). Therefore, it is particularly desirable that the distances from the $V_0$ bond pad to the $V_0$ connection of each resistor 36 be approximately equal. Likewise, the $V_8$ distance is preferably equal. Thus, $V_0$ and $V_8$ bond sites are the closest bond sites to the midpoint 39 of the circuit. By creating parallel resistor strings and keeping the distance from a given bond pad 35 to the corresponding input node of each resistor strings 36 approximately equal, the metal lead resistance from the bond pad to each string 36 (for example, the left or right resistor strings 36 in FIG. 3C) is approximately equal, and thus a more accurate voltage divider is provided.

Furthermore, a more accurate voltage divider is obtained if the first and last resistors (i.e., those adjacent to the $V_0$ and $V_8$ inputs) are adjusted slightly to compensate for the resistance in the metal lines from the bond pad to the resistor string input. Thus, for example, the resistance from the bond pads to the $V_0$ input plus the resistance across the first resistor should equal the resistance across the next 62 resistors in the string. The last resistor in the string may likewise be adjusted.

Power dissipation is a major consideration in many LCD modules because the modules often use battery power sources. According to the present invention, it is recognized that a non-trivial amount of the total power dissipation of an LCD module is caused by charging parasitic capacitances on the clock and data lines to the driver chips, such as bus lines 7 and 9 in FIG. 2. The voltage of such capacitive lines impacts the power dissipated within such lines because the power (P) dissipated by charging and discharging a capacitor (having capacitance C) at a frequency (f) and voltage (V) can generally be shown as:

$$P=CV^2f$$

The operating voltage of the signal driver digital circuitry also impacts the power dissipation since generally lower operating voltages results in lower power dissipation. Thus, to reduce power dissipation it is desirable to operate the LCD module and driver circuit at lower voltages.

However, in order to obtain high LCD pixel contrast ratios a high analog output voltage range, 5 volts for example, is typically desirable at each LCD panel column. Moreover, generally if an analog switch is to deliver up to a specific analog output voltage, such as 5 volts, then the control input to the switch must also operate at that voltage.

Therefore, according to the present invention, level shifting circuitry, such as level shifter circuitry 28 in FIG. 3, is utilized so that a portion of the signal driver operates at a voltage lower than the maximum analog output voltage. Level shifting circuitry allows portions of the LCD module and signal driver (Particularly the high frequency portions and the high capacitance portions) to operate at a low operating voltage, such as 3.3 volts or lower, while the analog outputs may have a higher range, such as 5 volts.

Figure 4:
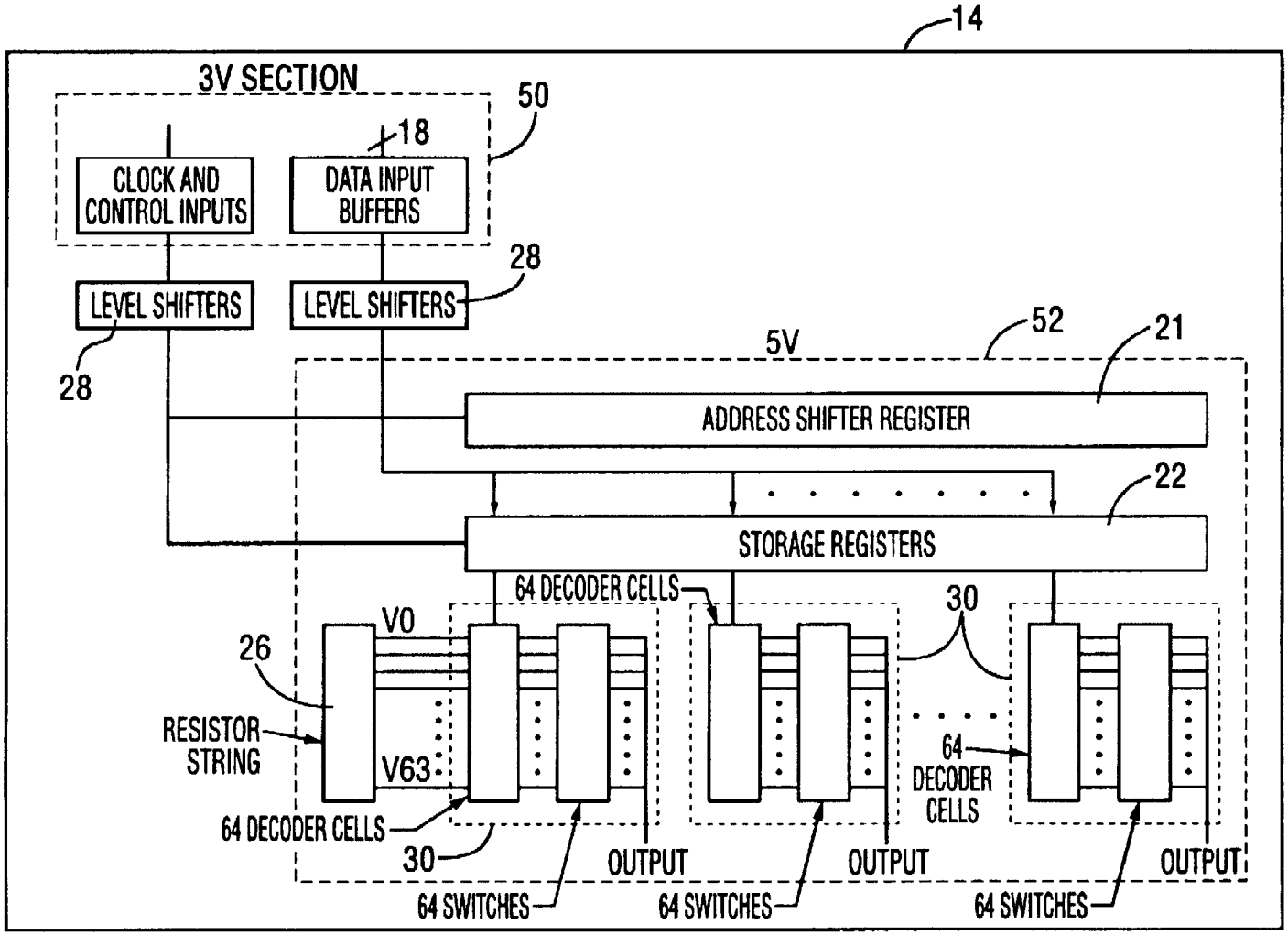
FIG. 4 is a block diagram of a signal driver circuit having level shifting.
Figure 5:
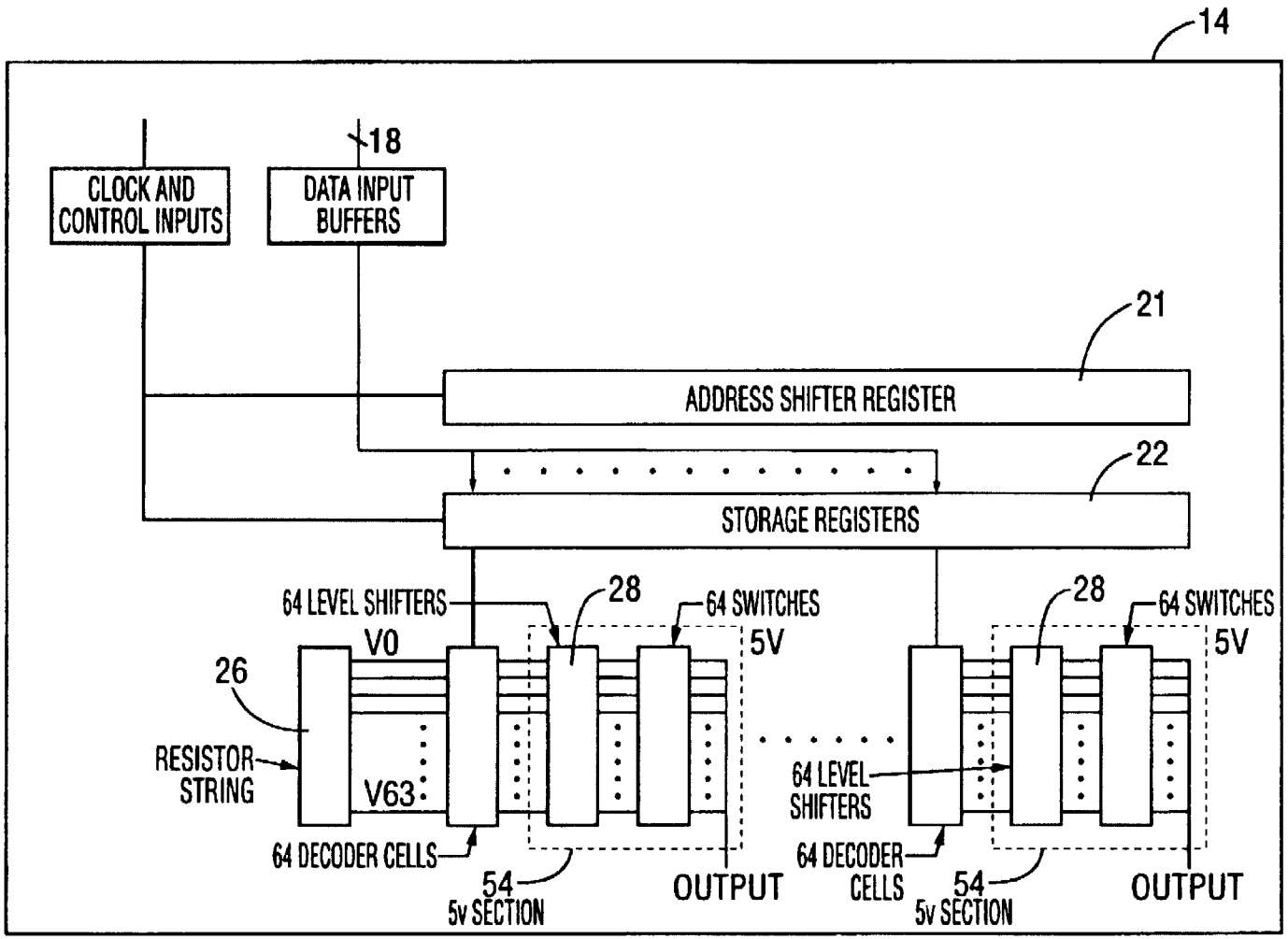
FIG. 5 is yet another block diagram of a signal driver circuit utilizing level shifting.

According to other embodiments of the present invention, level shifting, if desired, may be accomplished at a variety of other points inside the signal driver. FIGS. 4 and 5 are alternative level shifting embodiments of driver circuit 14. Driver circuit 14 in FIGS. 4 and 5 is similar to driver circuit 14 in FIG. 3; however, the placement of level shifter circuitry 28 is different between FIGS. 3, 4 and 5. The impact of the placement of the level shifter circuitry may be more easily described when considering a signal driver that drives two hundred one outputs at sixty-four separate voltage levels. As shown in FIG. 3, level shifter circuitry may be placed between storage regislers 22 and decoder circuitry 30. In this embodiment, 201×12 (201 outputs and 12 data lines per output) or 2,412 separate lines must be level shifted and, thus, 2,412 level shifter circuits would be employed. However, as shown in FIG. 4, the level shifters may be placed prior to the address shifter and storage registers, then only eighteen level shifter circuits would be employed for the data path (clocks and control signals would employ some additional level shifters). Finally, as shown in FIG. 5, level shifters may be employed with each specific analog switch such that for each analog output, sixty-four level shifters would be used, giving a total of 64×201 (12,864) level shifters used in signal driver circuit 14.

As discussed above, the location of the level shifters impacts the number of level shifters required. However, the location of the level shifters also impacts the amount of circuitry operated at a specific voltage level and, thus, the total power dissipation of the circuit. Though level shifting circuitry which is placed closer to the signal driver chip inputs requires fewer level shifters, the power dissipation advantages are less since less circuitry is operating at low voltages. For example, if operating levels of 3.3 volts and 5 volts are chosen, block 50 in FIG. 4 encompasses the 3.3 volt circuitry while block 52 encompasses the 5 volt circuitry. However, as shown in the embodiment in FIG. 5, if level shifters are associated with each switch at the output, then only block 54 need operate at 5 volts. Also, placement before the address shifter register requires the level shifters to operate at higher frequencies, thus adding to the complexity of the level shifter circuit. Thus, a number of factors impacts the optional placement of the level shifters.

Figure 6:
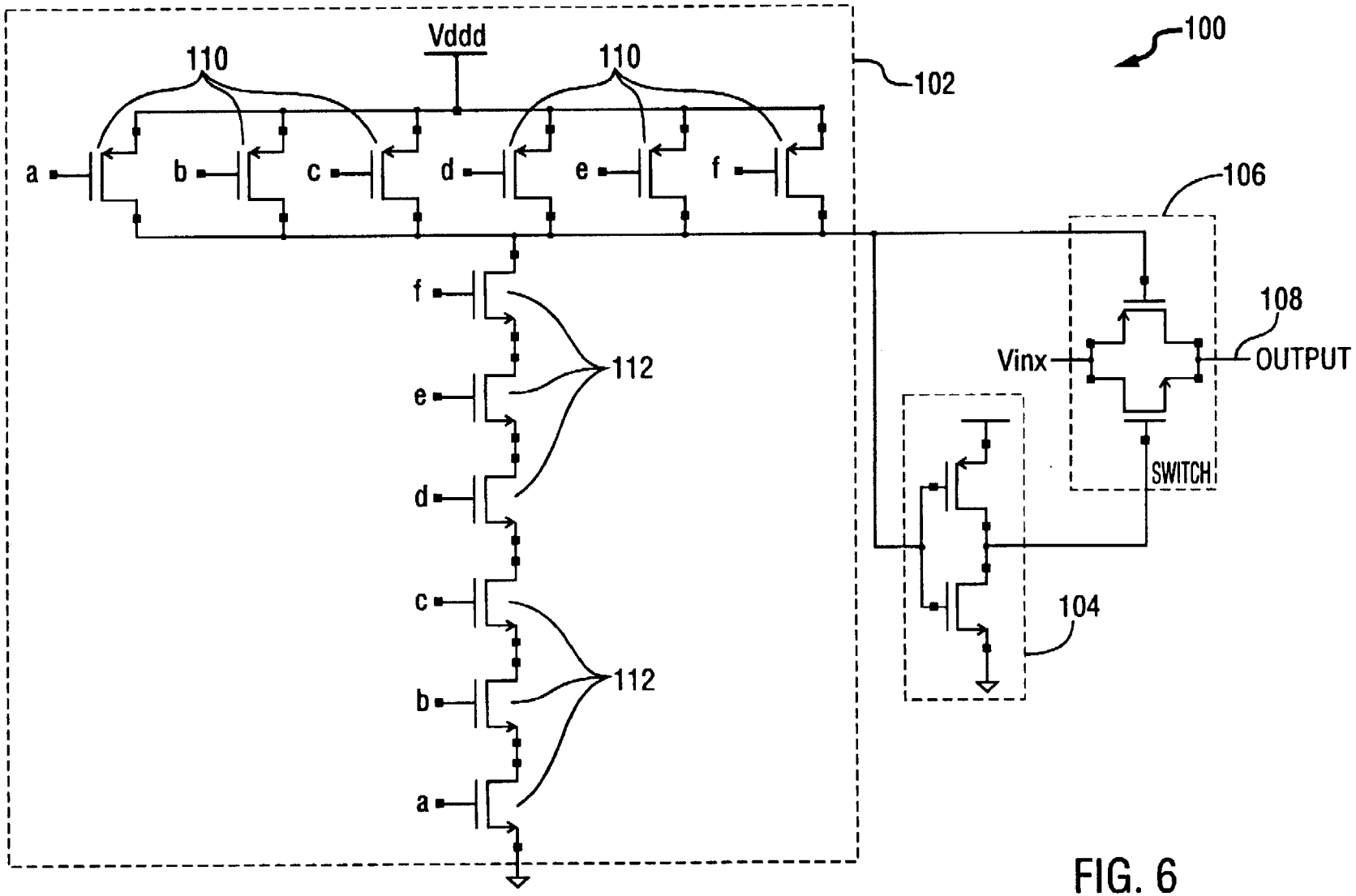
FIG. 6 is an electrical schematic of a decoder and associated circuitry.

FIG. 6 is a decoder cell schematic. The decoder cells in FIG. 6 may be used for decoder cell 46 in FIG. 3B or the decoder cells shown in FIG. 4. In FIG. 6, decoder cell 100 comprises NAND gate 102 and inverter 104. For illustrative purposes, a six data bit circuit (i.e. sixty-four output voltages) is used. The NAND gate data inputs are represented by data lines a, b, c, d, e and f. For illustrative purposes, a, b, c, d, e and f are chosen, and it will be recognized that depending on what six-bit number the decoder cell is programmed to decode, complimented data bits may be provided as the NAND gate input. NAND gate 102 includes a plurality of P-channel MOS devices 110 placed in parallel with each other as shown in FIG. 6. Furthermore, NAND gate 102 includes a plurality of N-channel MOS devices 112 placed in series as shown in FIG. 6. The output and inverted output (from inverter 104) of NAND gate 102 are then supplied to switch 106 such that a desired analog output voltage 108 may be supplied to an LCD column.

Figure 7:
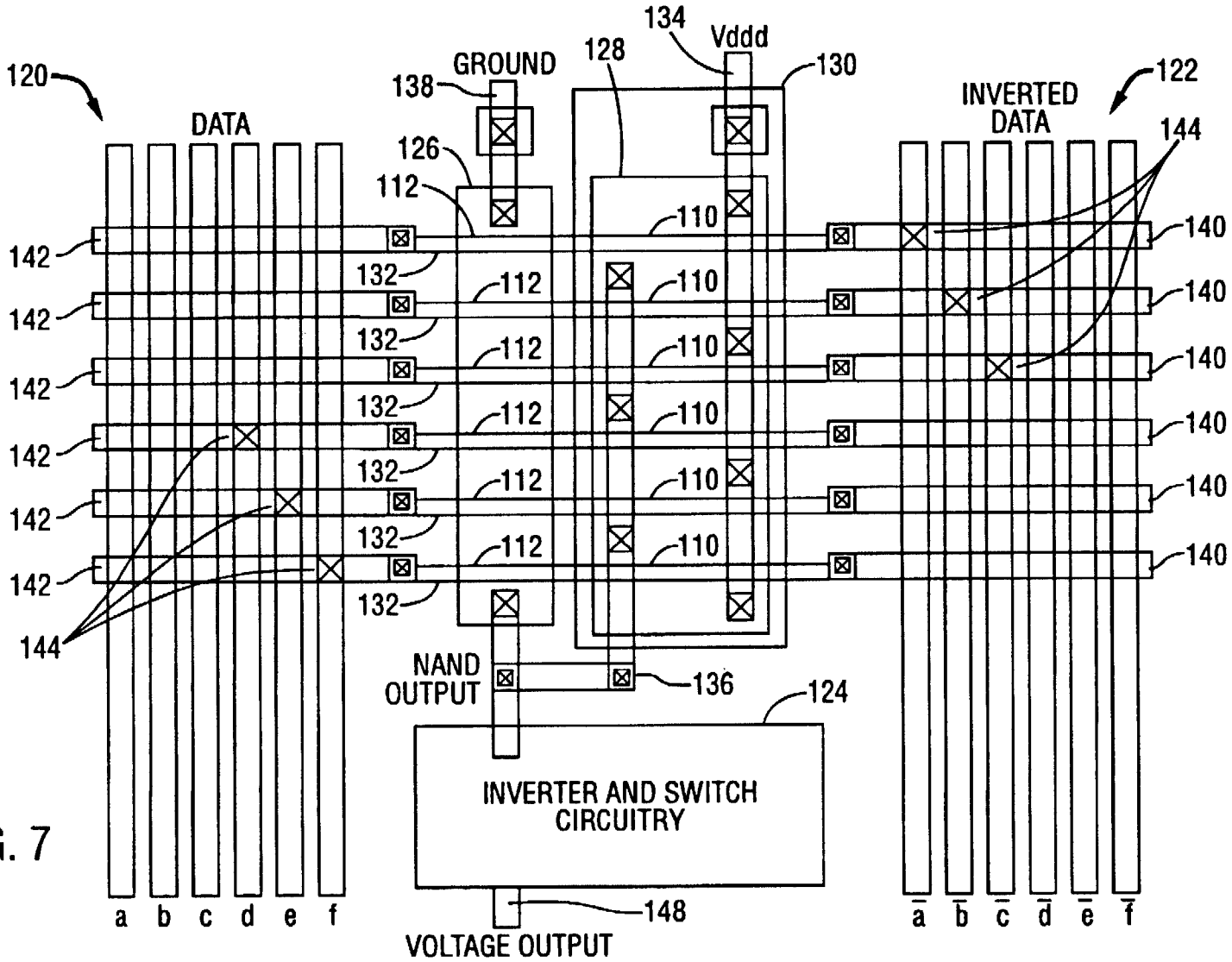
FIG. 7 is a cell layout of the schematic shown in FIG. 6.

The physical layout of the schematic shown in FIG. 6 may be seen in FIG. 7. Such a cell may be formed using conventional integrated circuit manufacturing technology typically in silicon. In FIG. 7, data bits a, b, c, d, e and f are delivered to each cell by a first set of parallel conductors 120. The inverted (or compliment) data bits are delivered to each cell by a second set of parallel conductors 122. Preferably, conductors 120 and 122 are formed in a second metal layer, however, other conductors may be used. Block 124 generally represents inverter 104 and switch 108. Block 126 represents the N-channel device area wherein N-channel transistors 112 will be formed. Block 128 represents the P-channel transistor region in which P-channel transistors 110 will be formed. Block 130 represents the N-well region associated with P-channel region 128. It is noted that the circuit shown is not drawn to scale. For example, those skilled in the art will recognize that general circuit layout requirements require a larger space between an N-channel region such as block 126 and an N-well region such as block 130.

Referring again to FIG. 7, conductors 132 are preferably polysilicon conductors used as gates for N-channel transistors 112 and P-channel transistors 110. Conductor 134 provides the common $V_{DDD}$ lines for P-channel transistors 110. N-channel transistors 112 connect in series between conductor 136 and ground 138. Conductor 136 connects to each P-channel transistor and to one N-channel transistor as shown in FIG. 7. Conductor 136, thus operates as the output line of the NAND gate structure.

Contacts or vias 144 to conductors 140 and 142 are used to program each decoder cell to select a specific six-bit number that is present on data lines 120 and 122. Preferably, conductors 140 and 142 are formed in a first metal layer. Programming of the decoder cell is accomplished by placing vias at the appropriate intersection of conductors 120 and 142 and the intersections of conductors 122 and 140. For example, as shown in FIG. 7, vias 144 are formed such that the cells shown decodes the six-bit a compliment, b compliment, c compliment, d, e and f. Thus, the decoder cell enables a digital number present on the data lines to be decoded, and then the cell selects a switch so that the corresponding desired analog voltage output is selected for output 148.

Figure 8:
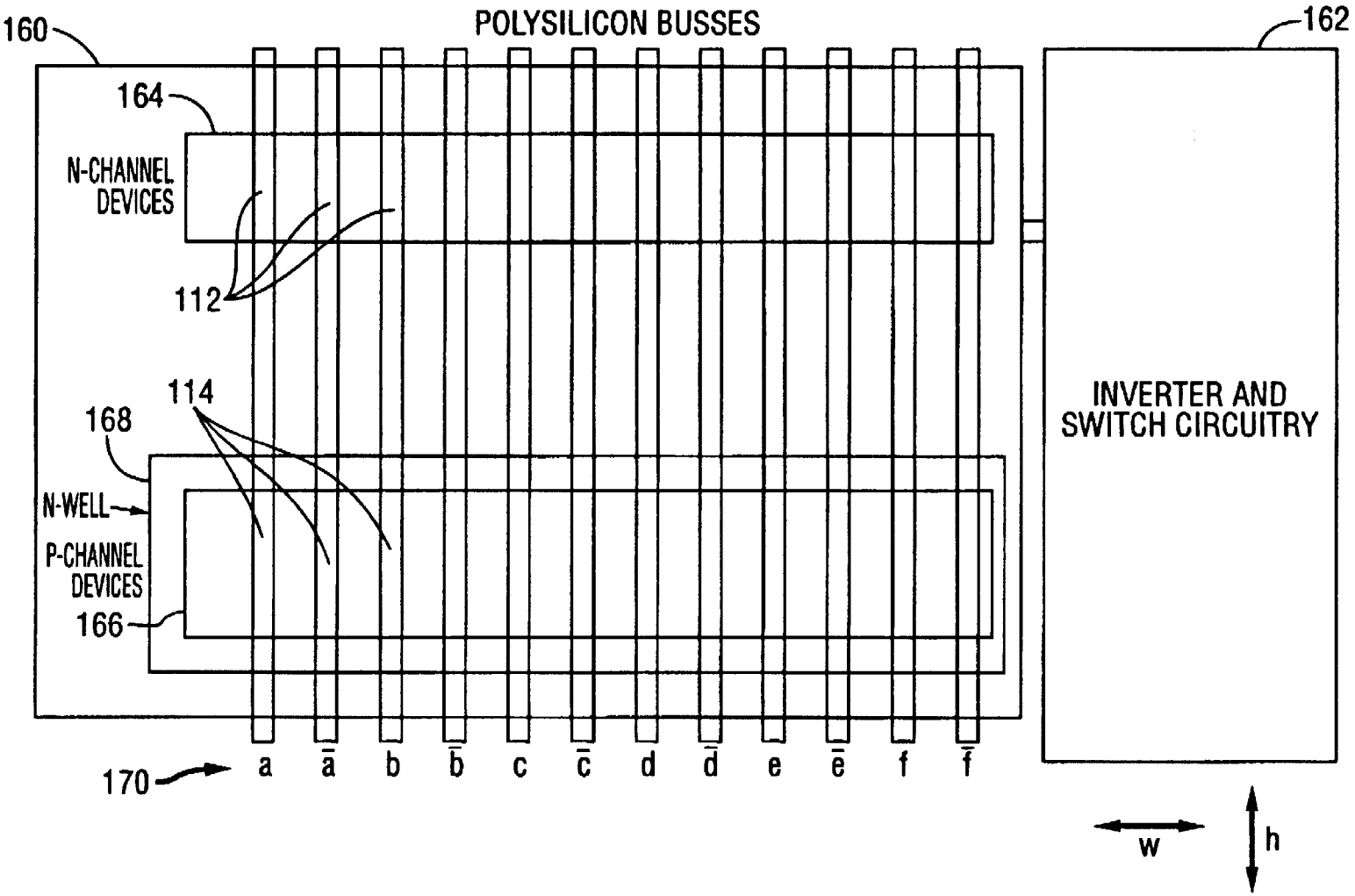
FIG. 8 is another cell layout of the schematic shown in FIG. 6.

FIG. 8 is an alternative cell layout for the decoder cell shown in FIG. 6. With reference to both FIGS. 6 and 8, block 160 represents NAND gate circuitry 102 and block 162 includes the circuitry of switch 106 and inverter 104. Block 164 is the N-channel transistor active region which includes N-channel transistors 112. Block 166 is the P-channel transistor active region which includes P-channel transistors 114 (such as transistors 110 in FIG. 6). Block 168 is the N-well region that accompanies P-channel region 166. Data bits a, b, c, d, e and f and complimented data bits a, b, c, d, e and f are bused into the cell through bus lines 170, for example polysilicon lines. Thus, as seen in FIGS. 8 and 8C, the cell does not require contacts made to the bus lines. The present invention is not limited to the order of the data bus lines shown in FIG. 8. For example, the bus lines may be arranged so that a data bit and its compliment are bused adjacent to each other. Alternatively, all data bits may be grouped as six bus lines and all compliments grouped as six bus lines. Finally, other random orders may also be used.

Within the signal driver circuit, the cell shown in FIG. 8 will be repeated sixty-four times for each column output, substantially across the height of the chip. Thus, for example, bus lines 170 may extend substantially from the bottom to the top of signal driver 14. The cells may then be stacked above each other within the layout. Since bond pads for the output columns may be placed along the bottom of the chip and such bond pads require a user defined separation (80 microns in one embodiment), the width of each cell (direction w in FIG. 8) is predefined. Thus, in order to reduce the area of the cell, the height of each cell (direction h in FIG. 8) must be reduced. Therefore, according to the present invention a cell design emphasizing height reduction has been provided.

Bus lines 170 are polysilicon lines that also function as the gates for N-channel transistors 112 and P-channel transistors 114. While using polysilicon as bus lines raises the bus line resistance compared to metal bus lines, this characteristic does not impact the cell severely because the signals on bus lines 170 are changing slowly. The layout of N-channel transistors 112 and P-channel transistors 114 as shown in FIG. 8 results in a circuit that may be illustrated as in FIG. 8A. Thus, N-channel transistors 112 are laid out as a strand of abutting transistors that have shared active areas (or source drain areas) between ground 172 and NAND gate output 174. However when programmed, of the twelve transistors 112 only the six transistors that correspond to the six-bit number the decoder cell is programmed to decode will be left connected in series between ground 172 and NAND gate output 174. Likewise, P-channel transistors 114 are laid out as a strand of abutting transistors that have shared active areas. However when programmed, of the twelve transistors 114 only the six transistors that correspond to the six-bit number the decoder cell is programmed to decode will be connected in parallel between $V_{DDD}$ and the NAND gate output.

Figure 8A:
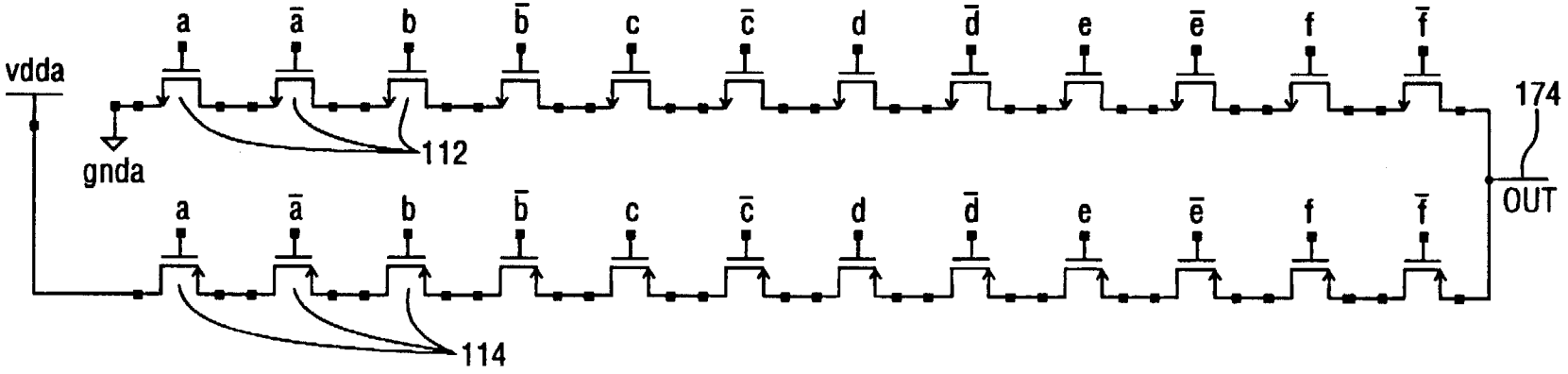
FIG. 8A is an electrical schematic of a portion of the cell layout of FIG. 8.
Figure 8B:
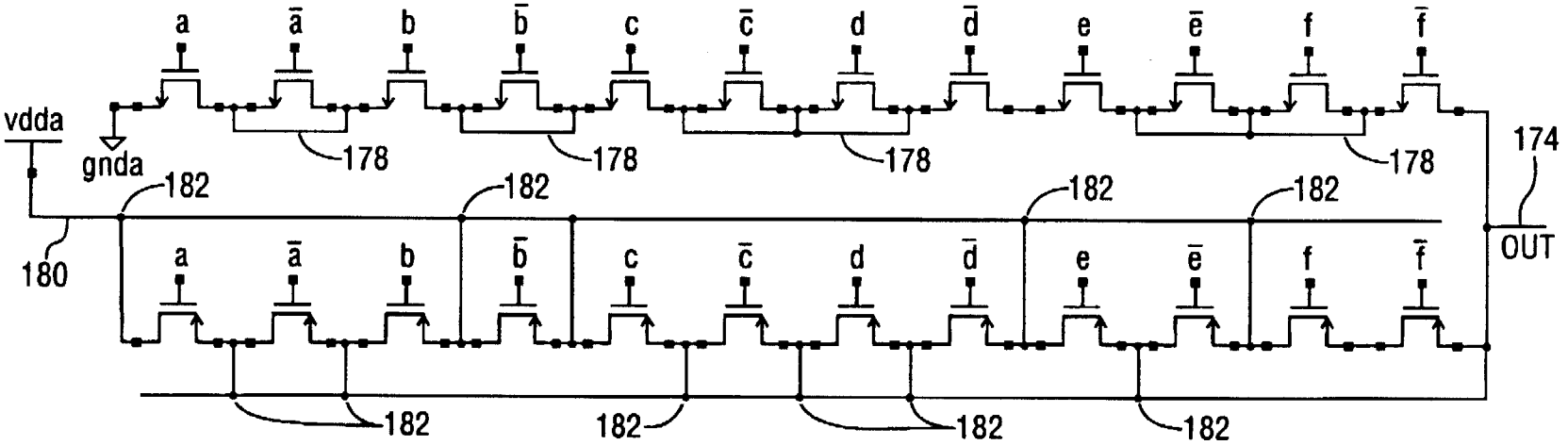
FIG. 8B is an electrical schematic illustrating the programmability of the schematic shown in FIG. 8A.
Figure 8C:
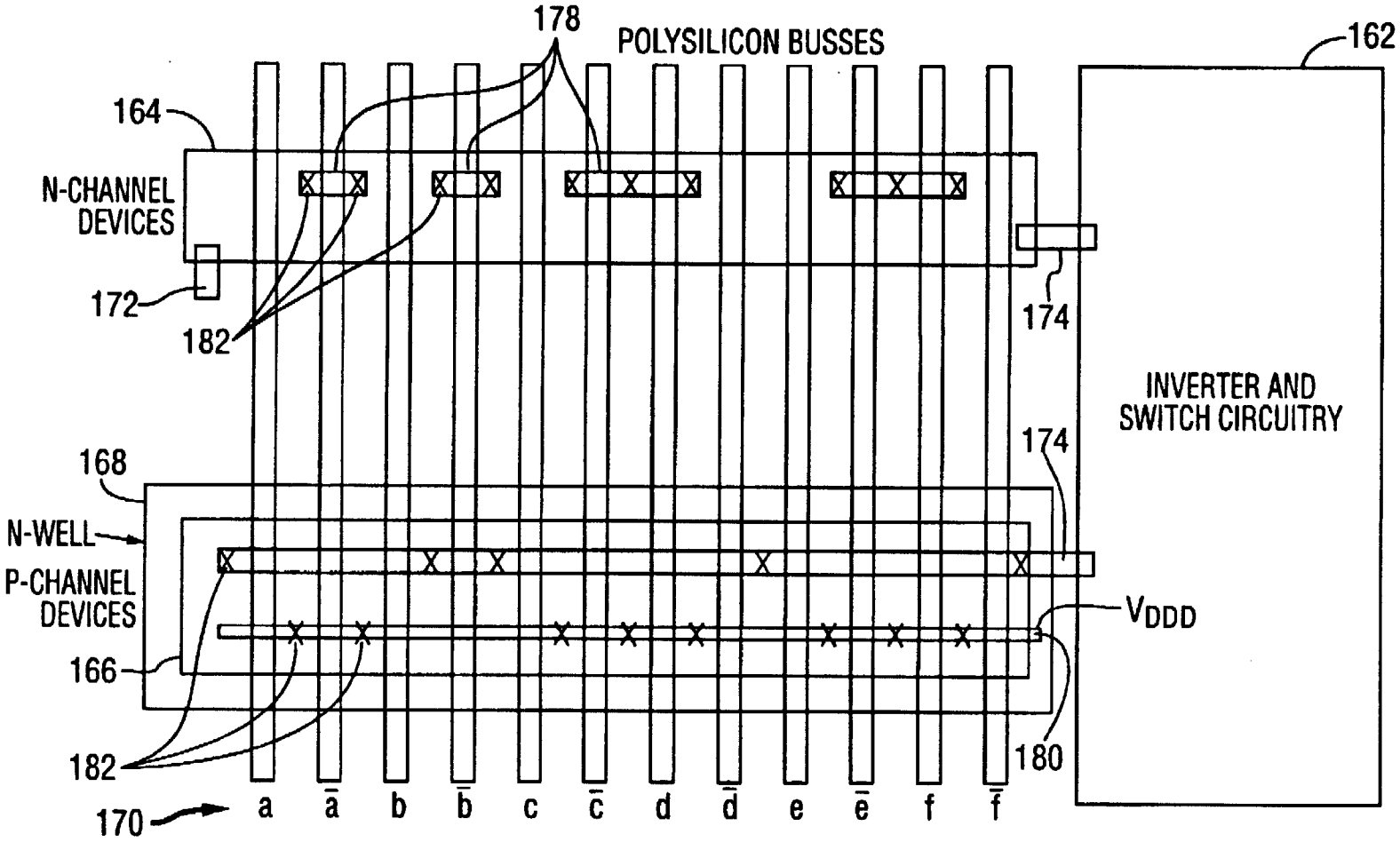
FIG. 8C shown a programmed cell of the cell layout shown in FIG. 8.

The method of programming the circuit shown in FIGS. 8 and 8A may be seen more clearly with reference to FIGS. 8B and 8C. Transistors 112 that are not used for the series transistors for a particular decode state are shorted out. Unused transistors 112 are shorted by contacting a metal strap 178 between the transistor source and drain. For example as shown in FIGS. 8B and 8C, the cell is programmed to decode the six-bit numbers a, b, c, d compliment, e and f compliment, thus metal straps 178 and contacts 182 are placed between the source and drain of the transistors which have as gates polysilicon bus lines a compliment, b compliment, c compliment, e, e compliment and f.

P-channel transistors 114 that are used for the particular decode state are connected in parallel between $V_{DDD}$ line 180 and NAND output line 174. Six P-channel transistors 114 are connected in parallel to correspond to the six-bit number the decoder cell is programmed to decode. The desired P-channel transistors are selected by placing contacts 182 at the source and drain locations required to connect those transistors in parallel between $V_{DDD}$ and NAND output. The remaining P-channel transistors that are not used for the particular decode state are shorted out to either $V_{DDD}$ line 180 or NAND output line 174 through the placement of contacts 182. Thus, as shown in FIG. 8B and 8C, P-channel transistors 114 that correspond to the six-bit decode state A, B, C, D compliment, E and F compliment are connected in parallel between $V_{DDD}$ line 180 and NAND output line 174. Meanwhile, P-channel transistors corresponding to a compliment, c compliment, d, e compliment and f are shorted to $V_{DDD}$ line 180 and the P-channel transistor corresponding to b compliment is shorted to NAND output line 174. In general, P-channel transistors are shorted to line 174 or 180 such that the desired transistors are placed in parallel while the unwanted transistors are shorted.

As shown in FIG. 6, each decoder cell includes a parallel P-channel and series N-channel NAND gate input structure and an inverter that has both P-channel and N-channel devices. However according to the present invention, it is possible to utilize a NAND gate structure that utilizes input transistors that are all the same conductivity type. Utilizing a single conductivity type transistor for both the series and parallel input transistor strands provides significant reduction in the cell area because circuit layout design rule requirements between different conductivity types, such as design rule minimum distances between N-well and N-channel devices, may be alleviated between the series and parallel input transistors. This results in considerable cell area shrinkage (Particularly in cell height) for cells arranged such as in FIG. 8. Moreover, only using N-channel transistors as the NAND gate inputs lowers the input capacitance of the NAND gate because generally P-channel transistors must be sized larger than N-channel transistors to achieve the same drive strength, thus, resulting in more capacitance (and power dissipation) when using P-channel transistors in the NAND gate inputs.

Figure 9:
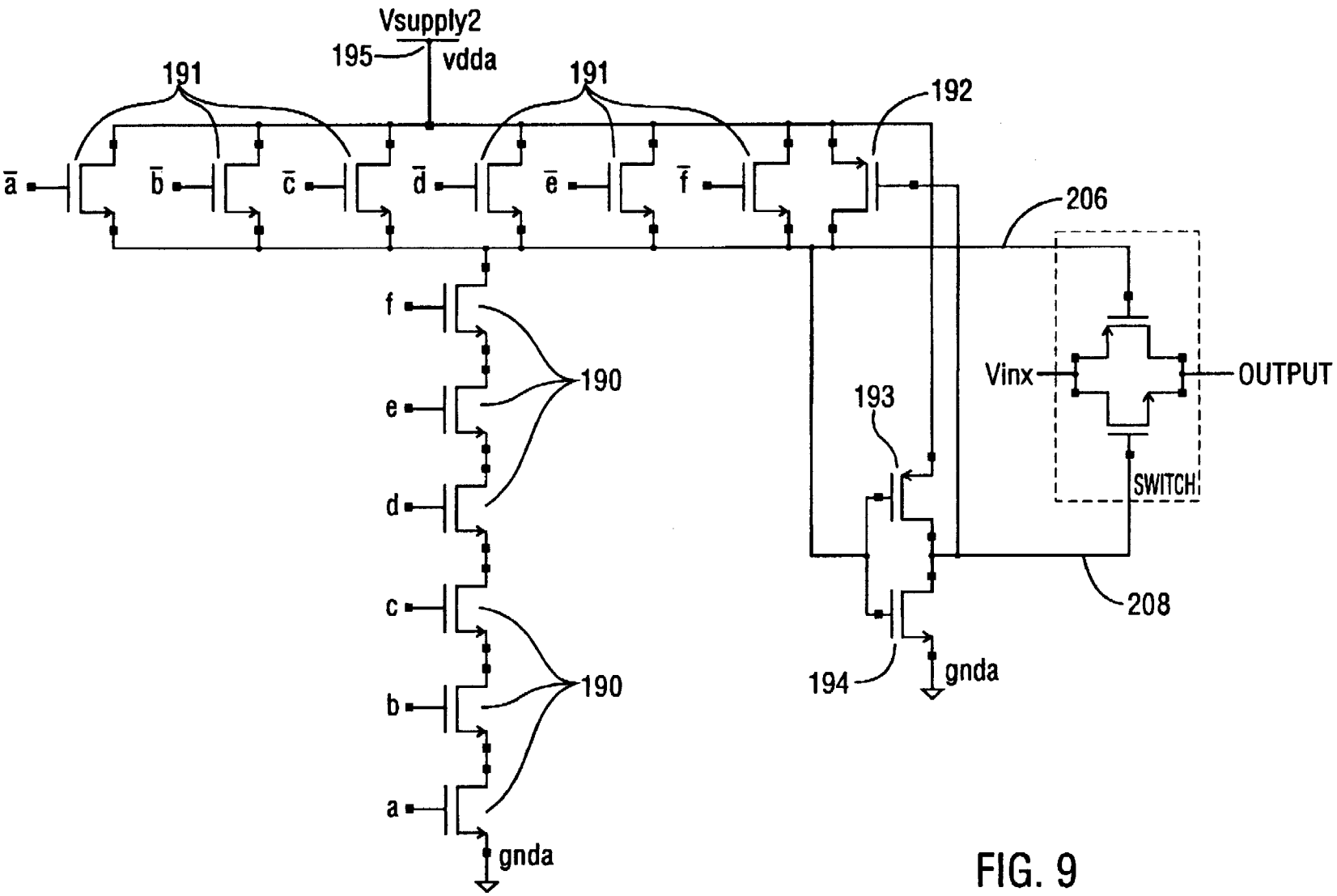
FIG. 9 is an embodiment of the electrical schematic of a decoder cell and associated circuitry of the present invention.

One such circuit using same conductivity NAND gate inputs is shown in FIG. 9. In FIG. 9, parallel input transistors 190 and series input transistors 191 are all N-channel transistors. In this arrangement, series transistors 190 receive the data corresponding to the decode state the cell is programmed to decode while parallel transistors 191 receive the compliments of the data corresponding to the decode state the cell is programmed to decode. Thus, as shown in FIG. 9, the cell is programmed to small decode state a, b, c, d, e, and f. Transistors 192, 193 and 194 operate to provide an output and output compliment with no static current drawn by the cell.

Figure 9A:
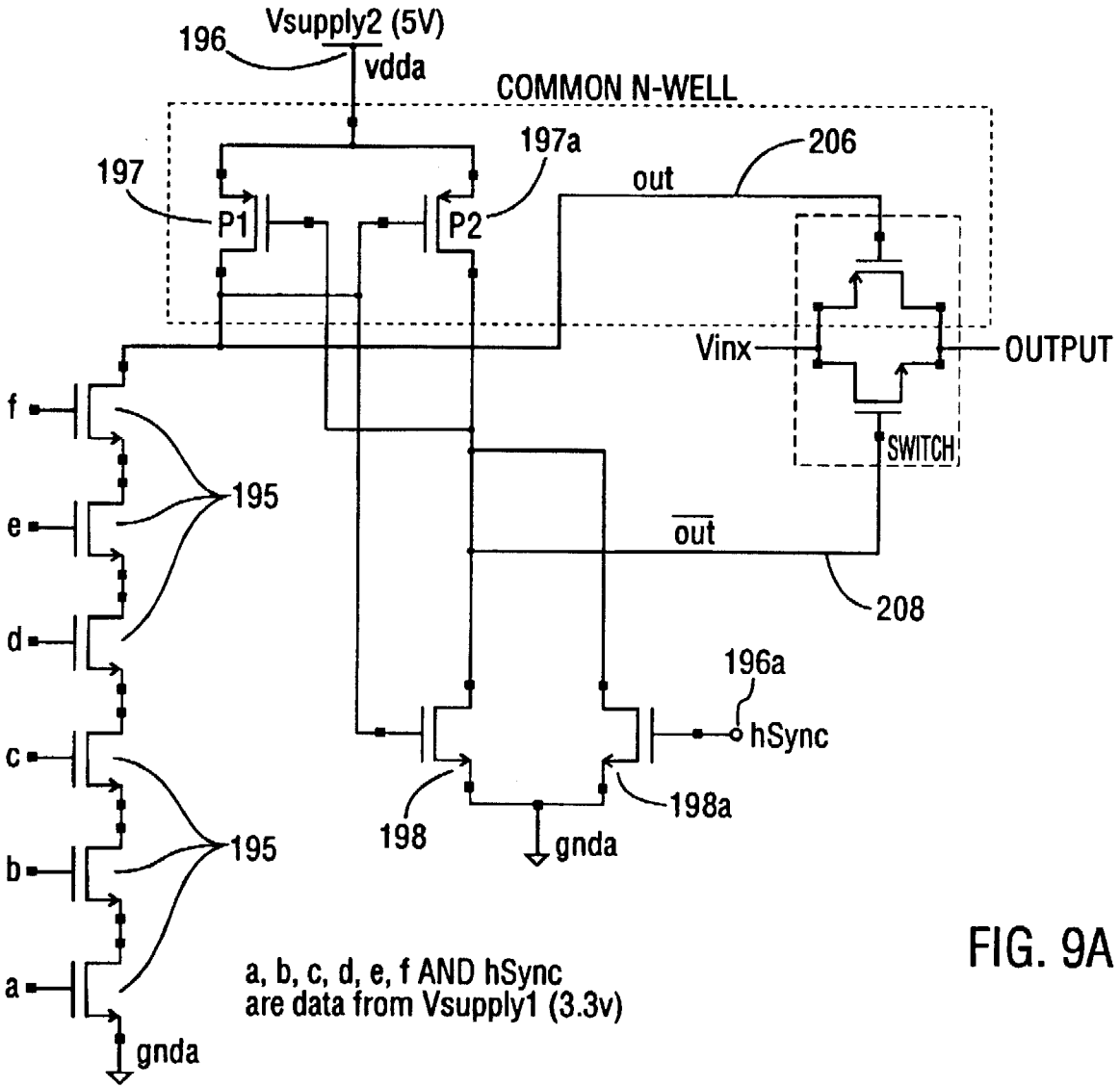
FIG. 9A is another embodiment of the electrical schematic of a decoder and associated circuitry of the present invention.

Another circuit using only N-channel transistors as inputs for the data bits is shown in FIG. 9A. This circuit utilizes series transistors 195 to receive data bits a, b, c, d, e, and f (the desired decode state shown) coupled to devices 197, **197*a*, 198 and 198*a* to perform a latch type function of the decode states. The circuit in FIG. 9A does not require the parallel transistor strand, rather transistors 197, 197*a*, 198, and 198*a* complete the NAND/latch function and provide an output 206 and output compliment 208. Node 196*a* provides a reset node which may be tied, for example, to HSYNC. As an alternative to the circuit shown in FIG. 9A, the series transistor strand of FIG. 9** may be deleted while the parallel transistor strand retained.

Figure 9B:
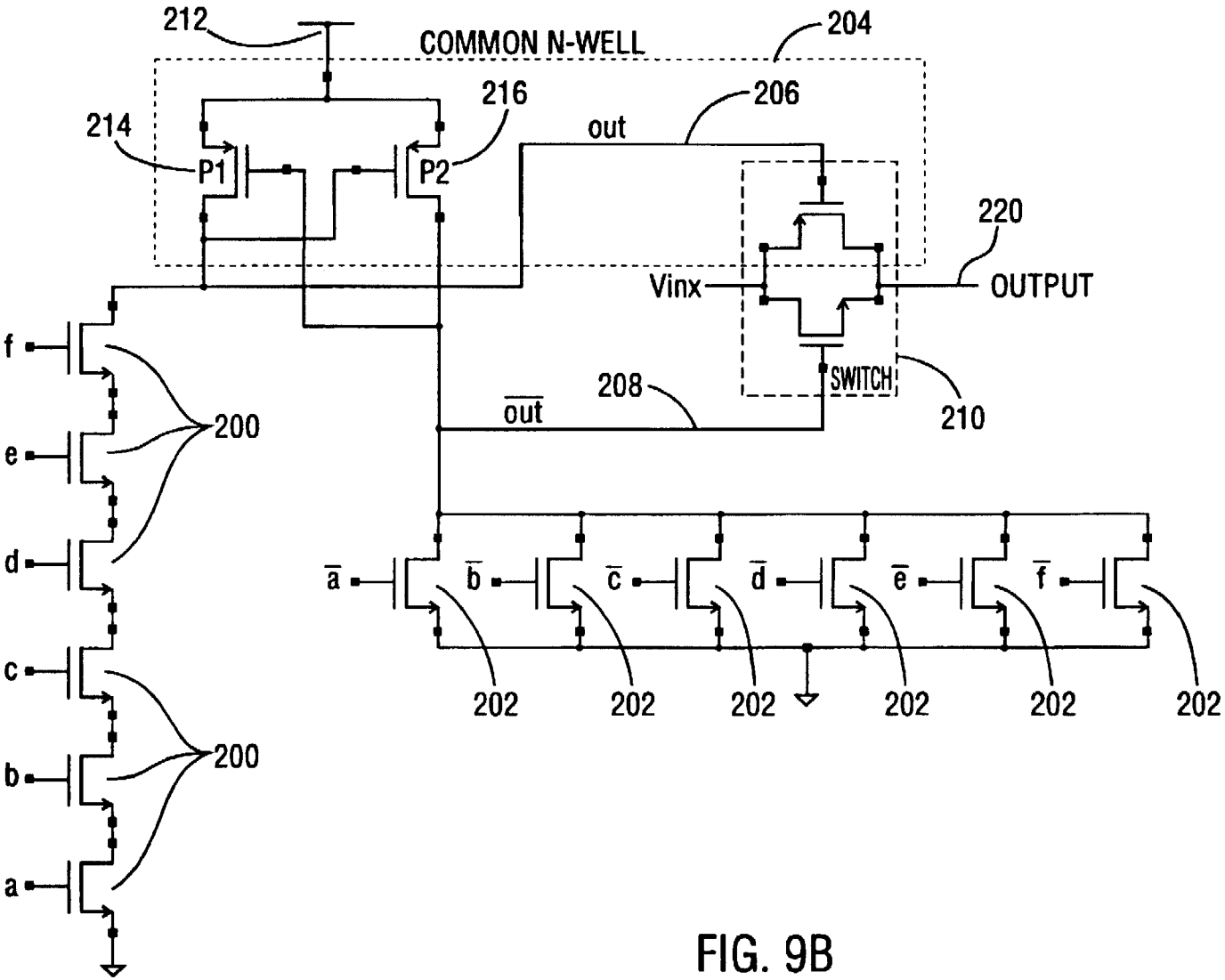
FIG. 9B is yet another electrical schematic of an embodiment of the decoder and associated circuitry according to the present invention.

FIG. 9B shows yet another circuit utilizing the same conductivity type transistor as the data input transistors for the NAND gate. The circuit in FIG. 9B has a combination of series N-channel transistors 200 and parallel N-channel transistors 202. The series N-channel transistors 200 are each gated to the a-f data bit lines while transistors 202 are gated to the a compliment-f compliment data lines. This cell may also be laid out using bussed polysilicon conductors where depending on the six-bit number the decoder cell is programmed to decode, the source and drains of appropriate series N-channel transistors 200 will be shorted out, for example with metal straps, and the appropriate parallel N-channel transistors 202 will not be connected such as shown with reference to FIG. 8B and 8C. As may be seen in FIG. 9, 9A and 9B, the cells used in these embodiments require only three P-channel devices that may be conveniently placed in the same N-well 204. These circuits also provide a NAND signal 206 and inverted NAND signal 208 for use by switch 210.

As noted above, it is desirable to operate the signal driver circuit at a low supply voltage such as 3.3 volts or lower.

However, in order to allow the switches to provide an analog voltage of up to 5 volts, the circuit voltage levels must be shifted upward. The circuits shown in FIGS. 9, 9A and 9B provide a convenient method of shifting the voltage level within the decoder cell without requiring additional level shifting circuitry elsewhere. Furthermore, the decoder cells shown allow level shifting by bringing a node to a higher voltage. Thus, even within the cell additional level shifter circuitry is minimized and is cell area conserved. In FIG. 9, level shifting may be accomplished by providing a higher operating voltage at node 195. Similarly, in FIG. 9A a higher operating voltage may be provided at node 196. In FIG. 9B, the level shifting is performed by providing a higher voltage at node 212 to operate the two P-channel devices 214 and 216 that are merged into the output of the decoder cell. Since these two P-channel devices are not connected to the data lines, they may be located in the same N-well that contains the P-channel half of the switch. Similarly, this may be done for the circuits in FIGS. 9 and 9A.

It will be recognized that the circuits shown in FIGS. 9, 9A and 9B do not require level shifting. A user may utilize these circuits without level shifting by providing the standard supply voltage to nodes 195, 196 and 212 (for FIGS. 9, 9A and 9B, respectively). Thus, a user selectable level shifting circuit is provided and if a user desires to utilize only one supply voltage, the circuit is still functional and other aspects of the present invention are still applicable.

Level shifting will be described more particularly with reference to FIG. 9B. The FIG. 9B circuit may be used as a level shifting circuit if supply voltage ($V_{supply-2}$) for node 212 for P-channel transistors 214 and 216 is a higher voltage (for example, 5 volts) than the supply voltage for the data bit and compliment data bit lines (for example, 3.3 volts). In a typical design, P-channel transistors 214 and 216 are sized to be weak pull-up devices so that the N-channel devices may overcome the P-channel transistors to enable the circuit to change states. When the parallel N-channel transistors 202 are all turned off, then the series N-channel transistors 200 are all turned on, and output line 206 is pulled low. Pulling output line 206 low then turns on transistor 216 and this in turn pulls output compliment line 208 up to $V_{supply\ 2}$ at node 212 thus turning off transistor 214. The opposite occurs when the series transistors 201 are turned off and the parallel transistors 202 are turned on. Thus, no static current flows in either condition.

Therefore, though the data bits and their compliments are data from $V_{supply\ 1}$ at 3.3 volts, if $V_{supply\ 2}$ at 5 volts is connected to node 212, then the NAND gate output and the inverted NAND gate output 206 and 208, respectively, will now be 5 volt outputs. Thus, switch 210 may operate to supply analog voltage output 220 that may range as high as approximately 5 volts. The present invention is not limited, though, to 3.3 volts and 5 volts, and other voltages and amounts of level shifting may be used and the level shifting may be either up or down.

The decoder circuits of FIG. 9 and 9B function such that if the one unique decode state that a cell is programmed to decode is on the inputs to a cell, then all the series N-channel devices are turned on and all the parallel N-channel devices are turned off. Thus, the data bits that correspond to the unique decode state a cell is programmed to decode are provided to the series transistor gates while the compliment data bits are provided to the parallel transistor gates. As seen in FIGS. 9 and 9B, the cells are programmed to decode the state a, b, c, d, e and f. With specific reference to FIG. 9B, a decoding cell pulls NAND output line 206 to ground and NAND output compliment line 208 to 5 volts, causing switch 210 to be turned on. Likewise, if the particular decode state the cell is programmed to decode is not present on the inputs to a cell, one or more of the series devices will be turned off and one or more of the parallel devices will be turned on. This pulls output line 206 up to 5 volts and output compliment line 208 to ground causing the switch to be turned off.

Figure 9C:
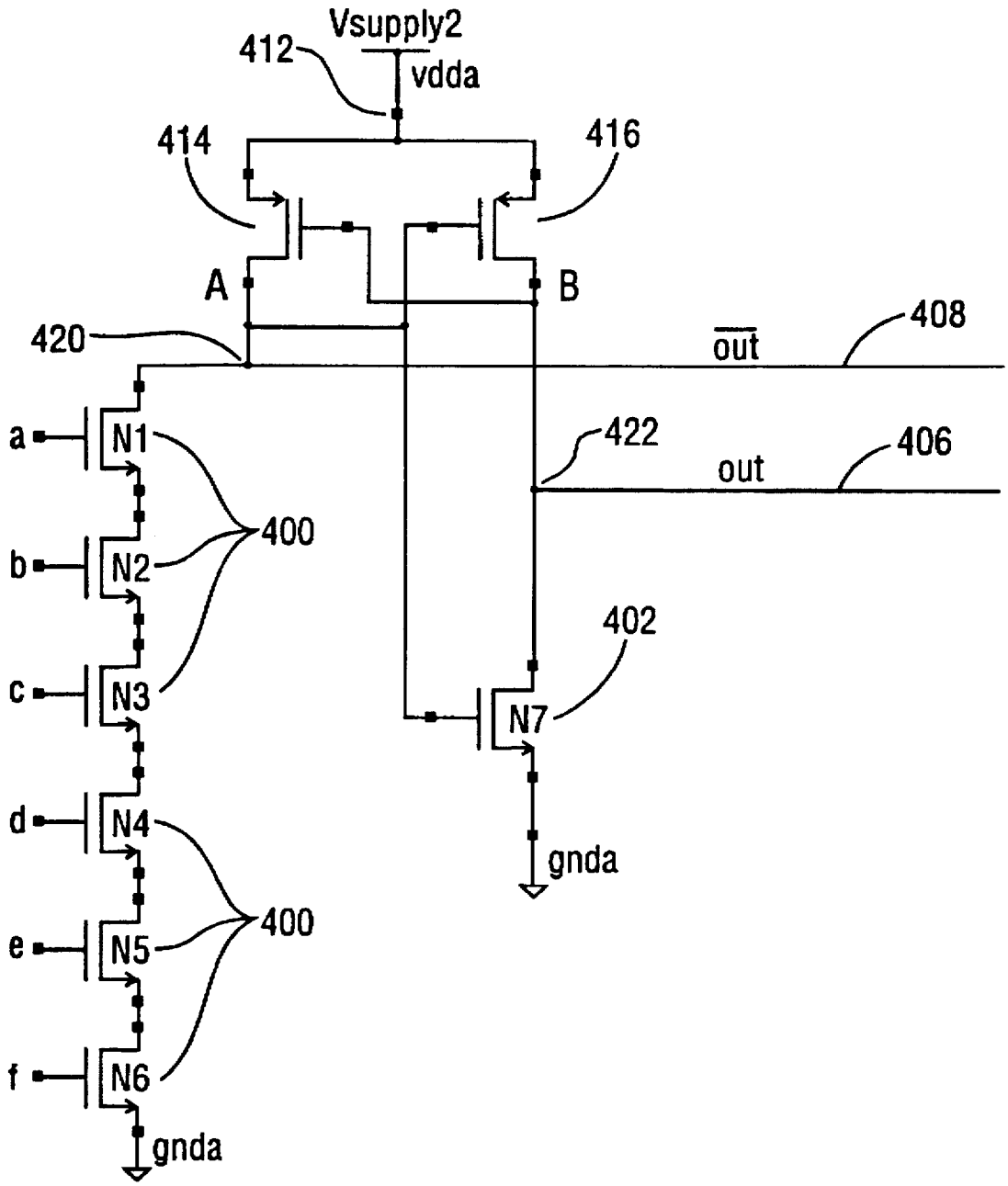
FIG. 9C is another electrical schematic of an embodiment of the decoder and associated circuitry according to the present invention.
Figure 9D:
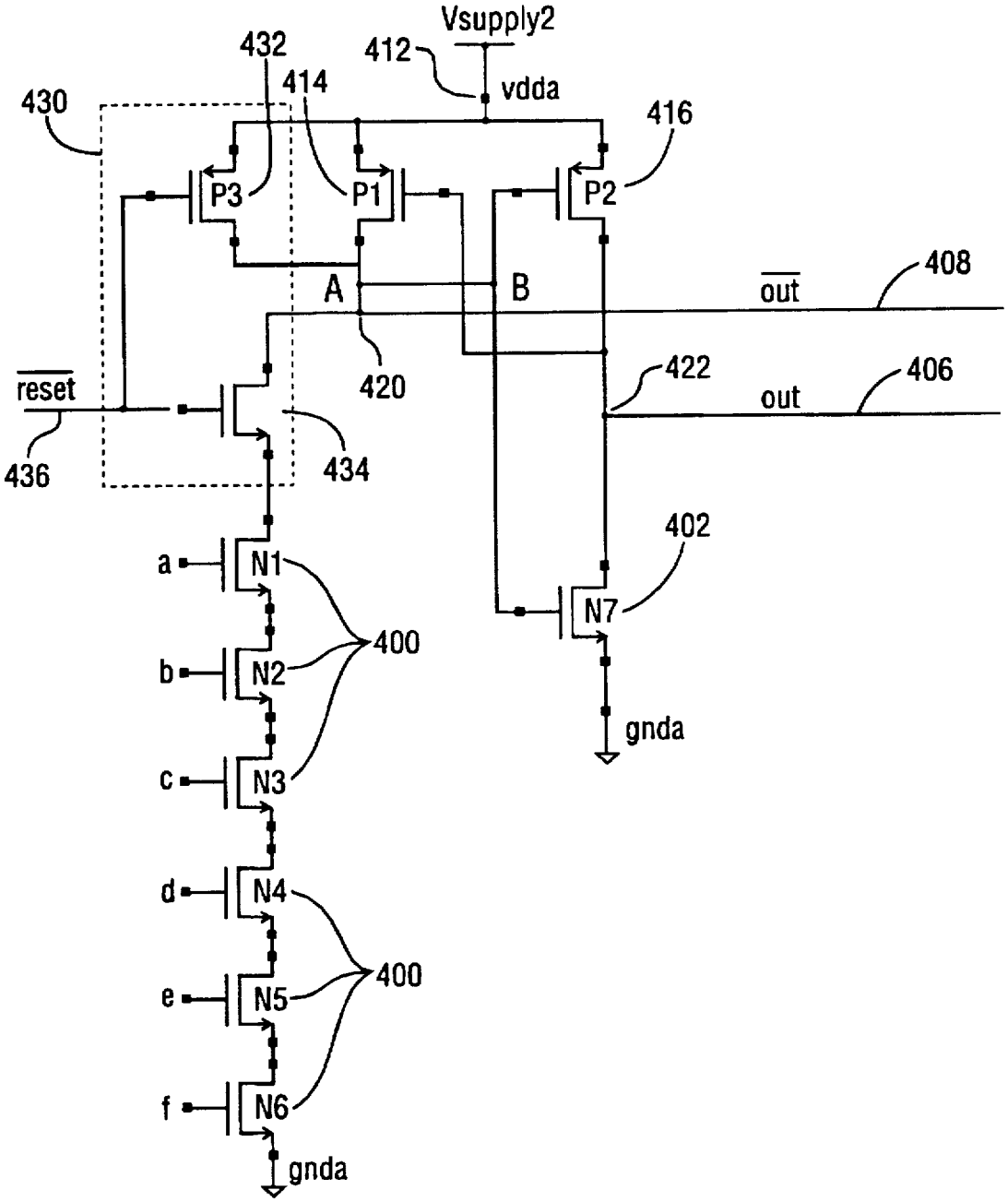
FIG. 9D is an electrical schematic of an embodiment of the decoder and associated circuitry shown in FIG. 9C with the addition of reset circuitry.

As discussed above, the circuit shown in FIG. 9B may be utilized to achieve level shifting while decoding a particular state. An alternative circuit, which may perform the same functions as the circuit shown in FIG. 9B, is shown in FIGS. 9C and 9D. The circuit shown in FIGS. 9C and 9D utilizes fewer transistors than the circuit of FIG. 9B and also may be realized in a smaller physical space.

The circuit of FIG. 9C is similar to the circuit of FIG. 9B except the parallel decoder input transistors 202 of FIG. 9B are replaced by a single transistor 402 in FIG. 9C. Similar to transistors 200 in FIG. 9B, the circuit of FIG. 9C also has a series of decode input transistors 400 (transistors N1–N6) which are gated to data bit lines. In the example shown, the transistors 400 are gated to the a, b, c, d, e, and f data bit lines so that the state decoded is a, b, c, d, e, and f. As with the circuit of FIG. 9B, the circuit of FIG. 9C also includes an output signal 406, an inverted output signal 408, p-channel transistors 414 and 416, and a voltage node 412. Level shifting of the output of the decoder may be affected by applying a higher voltage to node 412 (for example 5 volts) than the supply voltage for the data bit lines (for example 3.3 volts). Though not shown in FIGS. 9C and 9D, signal lines 406 and 408 may be connected to a switch such as switch 210 shown in FIG. 9B.

It will be recognized that the circuit shown in FIG. 9C operates as a latch and thus its operation is slightly different from that of the circuit of FIG. 9B. Whereas the circuit of FIG. 9B decodes simultaneously with both the series transistors 200 and the parallel transistors 202, allowing simultaneous conduction in one set of transistors and no conduction in the other set of transistors, the circuit of FIG. 9C decodes with the series transistors 400 only. For example, when the circuit is initially in the state where p-channel transistor 414 is conducting, inverted output node 420 is high and output node 422 is low, conduction through the series transistors 400 pulls down on node 420 and pulls against p-channel transistor 414. In spite of the series of n-channel transistors 400, by making p-channel transistor 414 weak, the proper relationship may be utilized such that the series n-channel transistors 400 will always overcome the p-channel transistor 414 and flip the latch. Then as node 420 falls toward ground, the p-channel transistor 416 is turned on and the output node 422 begins to rise. As node 422 rises nearly to the supply voltage at node 412, p-channel transistor 414 is cut off. This results in a stable latched condition.

Because the circuit shown in FIG. 9C operates as a latch, additional reset circuitry is required to reset the circuit to its original state. FIG. 9D shows reset circuitry 430. Reset circuitry 430 includes, for example, p-channel transistor 432, n-channel transistor 434 and reset line 436. Other reset circuits may also be utilized. The gates of transistors 432 and 434 are held high by reset line 436 during normal decoding. Before each new data word is decoded, the circuit of FIG. 9C is reset by taking the gates of transistors 432 and 434 low. This interrupts the current through the series transistors 400, even when the correct data to decode transistors 400 is on the data bit lines. Further, when the reset line is taken low, transistor 432 pulls node 420 back to the positive rail voltage of node 412. Then, the reset signal is returned to a high state, thereby allowing decoders without the proper data inputs to remain in the reset state and allowing the decoder which is receiving the proper input to conduct through the series transistors 400 as described above.

Figure 9E:
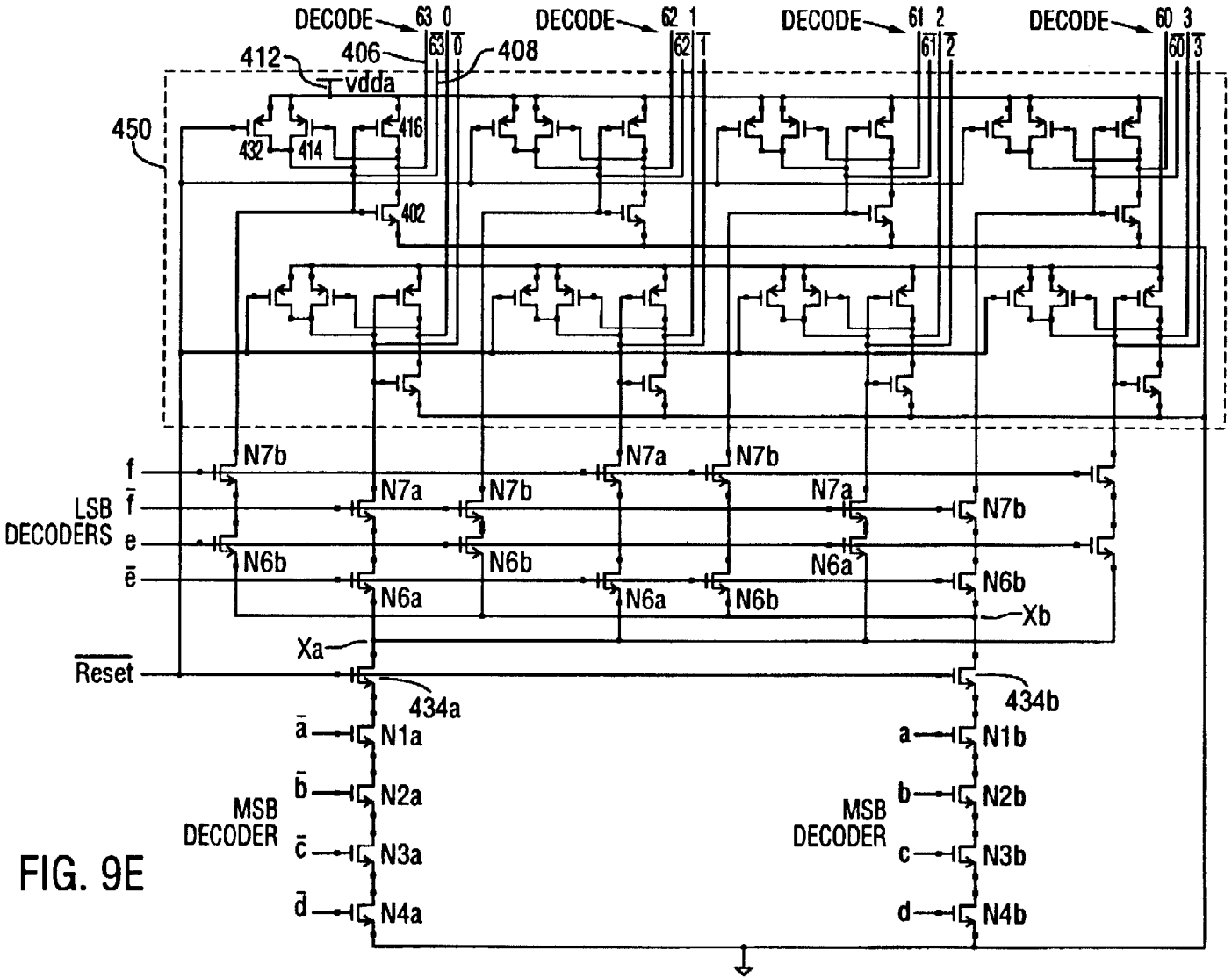
FIG. 9E is an electrical schematic of an embodiment of the schematic shown in FIG. 9D having shared MSB circuitry.

In one embodiment shown in FIG. 9E, several circuits of FIG. 9D may be grouped together such that portions of each decoder cell may be shared. The circuit shown in FIG. 9E decodes eight different states, however, portions of the reset circuitry and the series transistors are shared by more than one decoder cell. Thus, a larger decode cell is created by the combination of eight smaller decode cells. Sharing portions of the decoder circuitry allows reductions in the physical size of the overall decoder circuitry. FIG. 9E illustrates shared circuitry for eight decoders of six-bit data words. In FIG. 9E, only one unique output goes high for a given unique six-bit word (i.e., where 64 decoders are required to decode all states).

Portions of the decoders may be shared since although each decoder decodes a unique six-bit word, some of the bits of a given word will be the same as the bits in other words. As shown in FIG. 9F, a group of four of the 64 possible words, for example words 0, 1, 2, and 3, will have the same most significant bits (MSBs). Thus in this example the MSBs are bits a, b, c, and d (as used with reference to FIGS. 9C–9F, an "a" bit will be a 0 and an "compliment a" bit will be a 1 and likewise for b, c, d, e, and f). Because these four words have the same MSBs, it is possible to have decode circuitry for these MSBs which is shared by the decoders for words 0, 1, 2, and 3. To finish the decode, the four possible combinations of the remaining two least significant bits (LSBs), data bits e and f, must be decoded. Though as shown herein, four MSBs are shared and two LSBs are decoded separately, other combinations of the number of MSBs and LSBs may be utilized.

Referring again to FIG. 9E, the circuit shown has eight decoders which decode decimal outputs 0, 1, 2, and 3 (MSB=0000) and 60, 61, 62, and 63 (MSB=1111). Operating as transistors N1–N6 of FIGS. 9C and 9D, n-channel series transistors N1*a*, N2*a*, N3*a*, and N4*a* in FIG. 9E perform a decode of the 4 MSBs of a six bit binary word with MSB=0000. Likewise, operating as transistors N1–N6 of FIGS. 9C and 9D, n-channel series transistors N1*b*, N2*b*, N3*b*, and N4*b* in FIG. 9E perform a decode of the four MSBs of a six-bit binary word with MSB=1111. Each of these two partial decodes is shared by four LSB decoders and is responsible for pulling its respective node, Xa or Xb, to ground. A reset transistors 434*a* or 434*b*, similar to reset transistor 434 of FIGS. 9C and 9D, is also shared by four LSB decoders. The shared circuitry results in a much smaller cell by eliminating the need for extra transistors which would be otherwise required for each decoder.

For each of the possible four combinations of LSBs, the remaining LSBs associated with transistors N1*a*–N4*a* are decoded through two transistors N6*a* and N7*a* associated with each possible LSB state. Likewise, transistors N6*b* and N7*b* complete the decode associated with transistors N1*b*–N4*b*.

As discussed above, the circuit shown in FIG. 9E decodes eight six-bit words through eight decoders which share portions of circuitry. In addition to separate LSBs, the circuit of FIG. 9E also has additional circuitry 450 which is not shared and thus, for the example shown in FIG. 9E, is comprised of eight repeated circuits (one for each decoded word). Though repeated for each decoder, the additional circuitry will be discussed with reference to only one decoder, decoder 63. As with the circuit shown in FIG. 9D, decoder 63 in FIG. 9E also includes n-channel transistor 402, an output signal 406, an inverted output signal 408, p-channel transistors 414 and 416, and a voltage node 412. Further, reset transistor 432 is also associated with each decoder. These transistors operate similar to the operation described above with reference to FIGS. 9C and 9D.

Reset transistors 434*a* and 434*b* are located within the string of series n-channel transistors (N1*a*–N6*a* and N1*b*and N6*b* respectively) rather than at the beginning of each string as in FIG. 9D. However, the operation and of the latch and reset is similar to the description above except portions of the circuitry are shared as shown in FIG. 9D.

Figure 10:
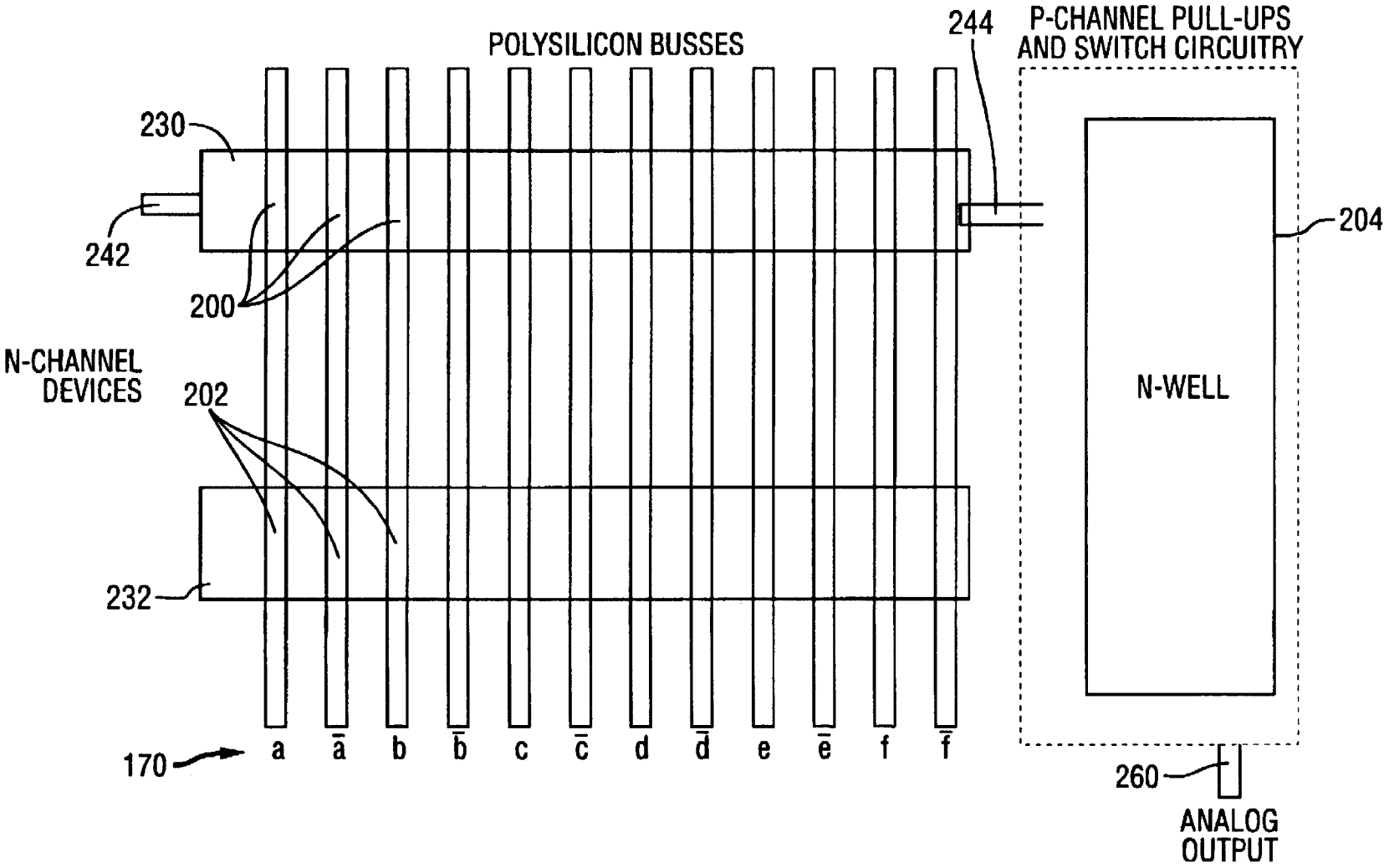
FIG. 10 is a cell layout of the electrical schematic shown in FIG. 9B.

A cell layout for the circuits shown in FIG. 9B is shown in FIG. 10. In FIG. 10, N-channel region 230 is provided for the plurality of series N-channel transistors 200 and N-channel region 232 is provided for the plurality of parallel N-channel transistors 202. Similar to the cell in FIGS. 8 and 8C, in FIG. 10 data bits and inverse data bits are bused into each cell through polysilicon buses 234. Once again, the present invention is not limited to the specific order of the data bits in buses 234 that is shown in the figures.

Figure 10A:
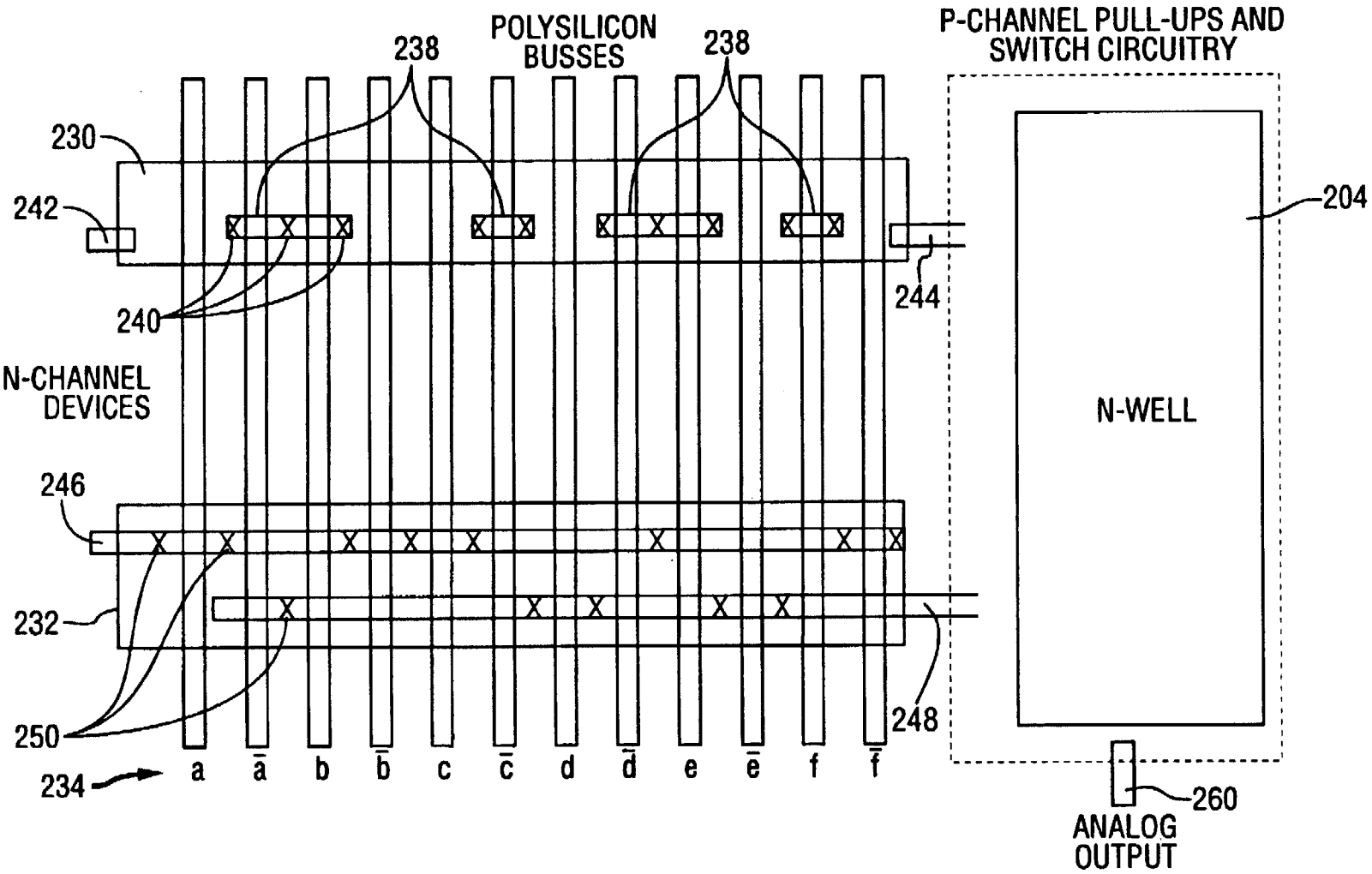
FIG. 10A shows a programmed cell of the cell layout shown in FIG. 10.

The programming of the cell shown in FIG. 10 is accomplished similar to the programming method described with reference to FIGS. 8, 8A, 8B, and 8C. Thus, depending on the particular six-bit number that the cell is programmed to decode, metal straps are provided to short out the source and drain of unwanted transistors in the N-channel series transistor string. For example, as shown in FIG. 10A, metal straps 238 and source drain contacts 240 are provided such that only the transistors corresponding to data bits a, b compliment, c, d, e compliment and f compliment are placed in series between ground 242 and NAND output signal 244.

Likewise, the appropriate parallel N-channel transistors within N-channel region 232 are programmed to decode the inverse of the six-bit number that corresponds to the unique decode state that the cell is programmed to decode. Thus, the proper transistors are programmed to be connected in parallel between ground line 246 and NAND inverted output 248, while the remaining transistors are shorted out to ground line 246 or NAND inverted output 248. For example as shown in FIG. 10, the transistors corresponding to data bits a compliment, b, c compliment, d compliment, e, and f are connected in parallel since the cell is programmed to decode the state a, b compliment, c, d, e compliment and f compliment. This programming of the parallel transistors may be made by placing appropriate source drain contacts along ground line 246 and NAND inverted output line 248. Lines 246 and 248 are preferably metal. Thus, as shown in FIG. 10, contacts 250 are used to connect in parallel the transistors corresponding to data lines a compliment, b, c compliment, d compliment, e and f while shorting the remaining transistors 200 to either lines 246 or 248.

In order to conserve cell area, the P-channel pull-up transistors 214 and 216, and the P-channel transistor within switch 210, may all be placed within N-well 204. The output of switch 210 is output line 260. Output line 260 is the analog output that is provided to an LCD column.

Figure 11:
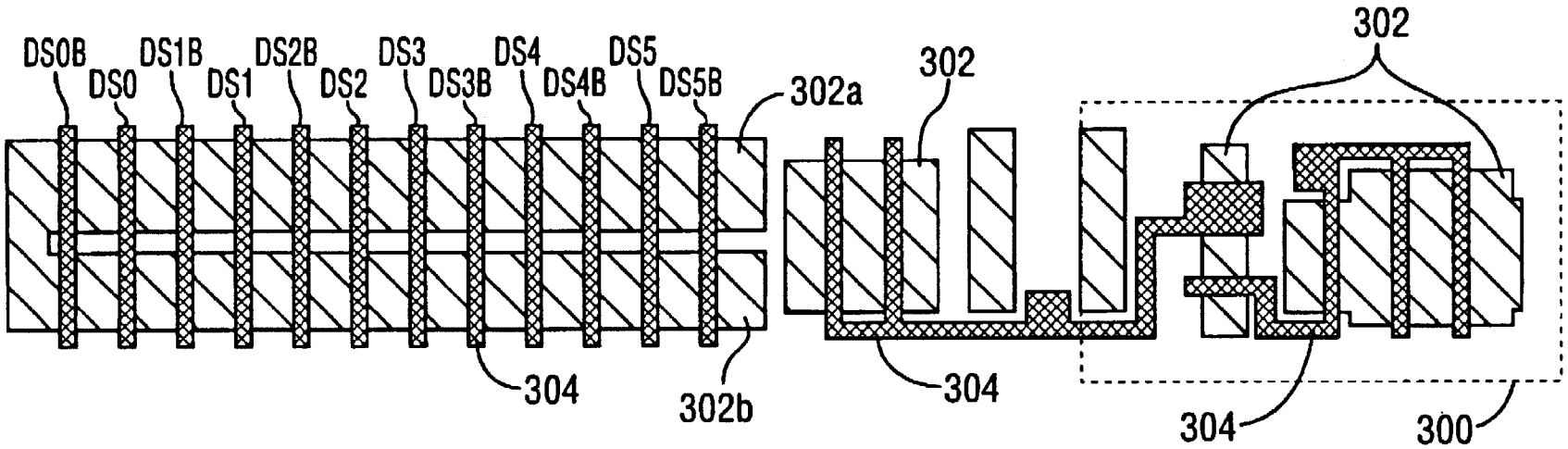
FIG. 11 shows the N-well, source drain (or active area) and polysilicon masking layers of the cell layout shown in FIG. 10.
Figure 12:
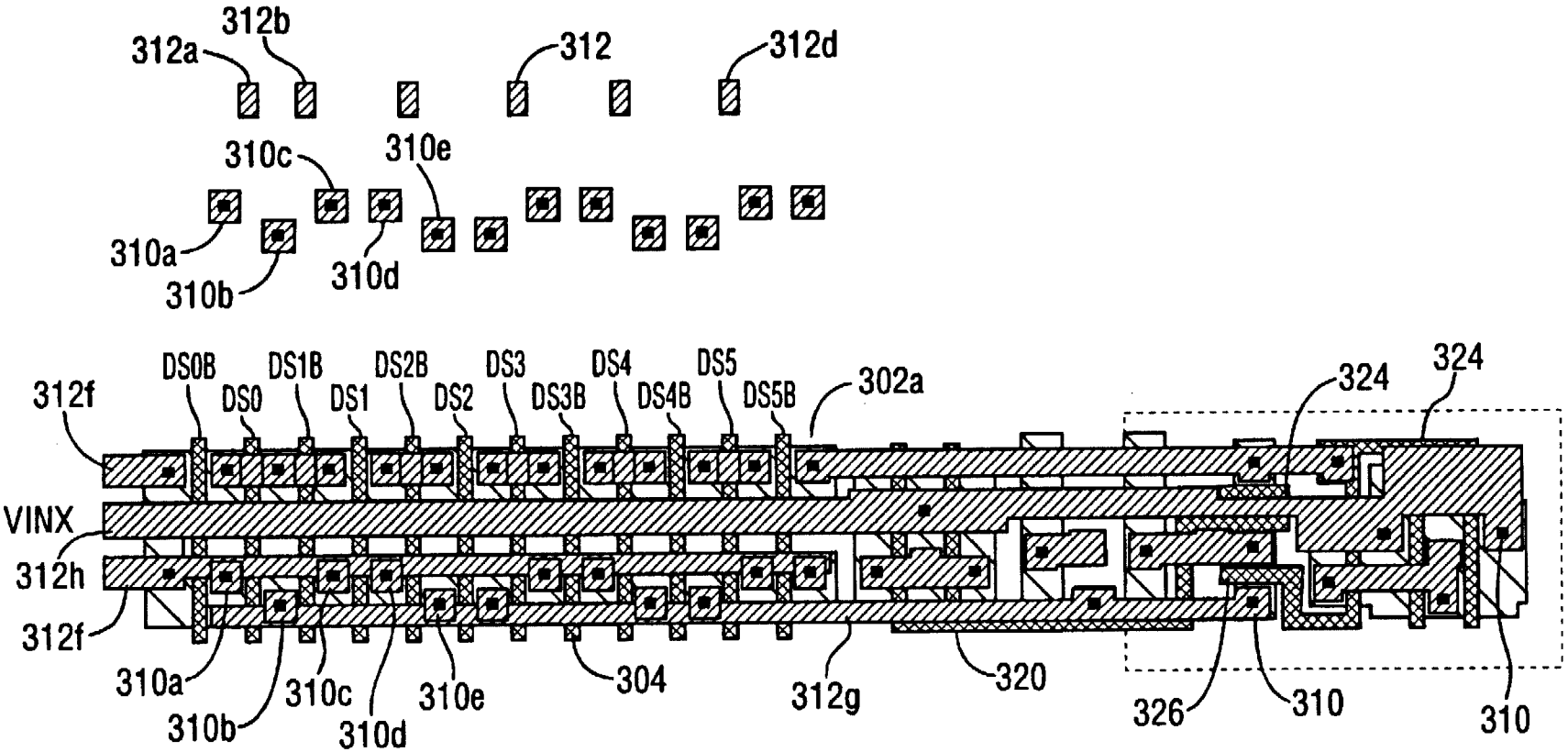
FIG. 12 shows the addition of contact and metal 1 masking layers to the masking layers shown in FIG. 11.
Figure 13:
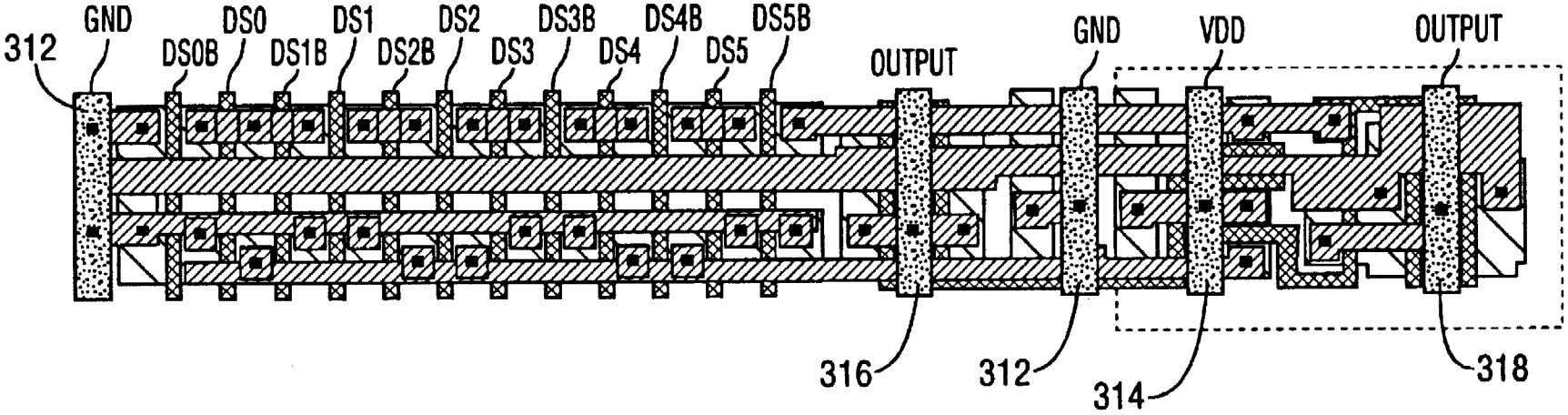
FIG. 13 shows the addition of the via and metal 2 masking layers to the masking layers shown in FIG. 12.

An embodiment of the semiconductor cell layout of the circuit shown in FIG. 9B is shown with more detail in FIGS. 11–13. In FIGS. 11–13, various layers of the cell layout are progressively shown. In FIG. 11, block 300 represents an N-well region. Regions 302 represent active areas (P type source/drains within the N-well and N type source/drains outside the N-well region). Polysilicon is represented by shaded regions 304. Data is bused into the cell via six polysilicon data lines, DS0–DS5, and six polysilicon compliment data lines, DS0B–DS5B (where "B" indicates a compliment data bit). Active region 302*a* represents the region where the serial N-channel transistors are formed and active region 302b represents the region where the parallel N-channel transistors are formed.

FIG. 12 is the same layout as FIG. 11 with the addition of the contacts 310 (squares) and metal one lines 312 (cross hatched). The contact layer and metal one layer may be used to program the cell. The programming contacts and metal have been shown both within and above the cell as referenced by 310a, 310b, 310c, etc. and 312a, 312b, 312c, etc. in order to more clearly show the programming of a particular decode state. It is understood that the contacts and metal straps shown above the cell are contained within the cell and are simply shown above the cell in the figure for illustrative purposes. As shown, the cell is programmed to decode data state DS0B, DS1, DS2, DS3B, DS4B, and DS5B. For example, metal strap 312a shorts series transistor DS0 and metal strap 312b shorts series transistor DS1B. Further, contacts 310a and 310b connect parallel transistor DS0 in parallel between ground 312f and $V_{DDD}$ 312g. Likewise, contacts 310c and 310d short parallel transistor DS1 to ground 312f. In a similar fashion the remaining programming can be seen from the figure. $V_{in}$ is also bused into the cell through conductor 312h (such as conductors 38 in FIGS. 3C and 3D). N-channel switch transistor 320, P-channel switch transistor 322 and two P-channel pull-up transistors 324 and 326 are also provided.

FIG. 13 is similar to FIG. 12, however, via and metal 2 layers are overlayed. Thus, the placement of metal 2 ground lines 312, $V_{DDD}$ lines 314 and analog output line 316 and 318 are shown. Output lines 316 and 318 may be tied together outside the cells, such as at one end of a column of cells.

Figure 14:
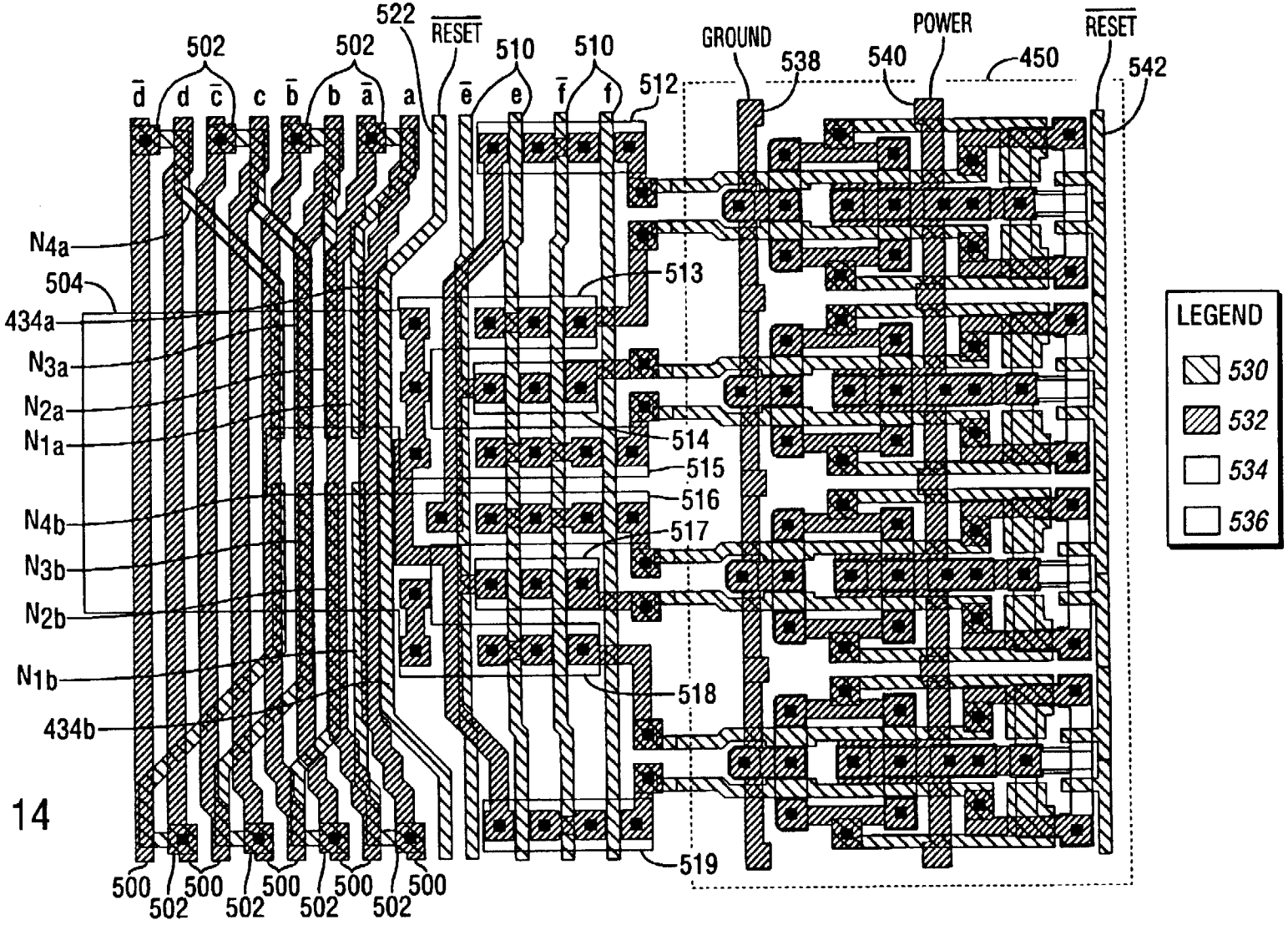
FIG. 14 is a cell layout of the electrical schematic shown in FIG. 9E.

An embodiment of the layout of the circuit shown in FIG. 9E is shown in FIG. 14. The cell shown in FIG. 14 includes eight decoders and, thus, decodes eight states. To decode the full 64 states, eight cells similar to the cell shown in FIG. 14 are utilized. The layout is made to allow convenient stacking of cells, as many signals may connect to each abutting adjacent cell. However, other arrangements are possible. In FIG. 14, a polysilicon pattern 530, a metal pattern 532, a P+ active area 534 and a N+ active area 536 are all shown.

As shown FIG. 14, the MSB data and their inverses (in this case two sets of four MSBs: a, b, c, and d and a compliment, b compliment, c compliment and d compliment) are routed through all of the cells in metal lines 500. Thus, metal lines 500 are routed through all the adjacent cells that form a stack of eight cells above and/or below any particular cell. When any data bit or its compliment is needed for the gates of the shared MSB decoders, polysilicon lines 502 are contacted to the appropriate metal lines. In FIG. 14, polysilicon lines 502 thus contact metal lines 500 such that the two sets of selected MSBs are a, b, c, and d and a compliment, b compliment, c compliment and d compliment. The remaining MSBs combinations are selected in the other seven cells of a stack can by similarly contacting polysilicon gate lines to the appropriate metal data lines. The polysilicon lines 502 then cross active area 504 to create the series transistors N1*a*–N4*a* and N1*b*–N4*b* that are used to decode the MSBs.

The LSBs and their inverses are routed by polysilicon lines 510 to all the decoder cells in the stack of cells (eight cells in the example discussed herein). Thus as shown in FIG. 14, e, e compliment, f, and f compliment data are routed with polysilicon lines 510. Eight active areas 512–519 are provided for polysilicon lines 510 to cross to form the LSB decode transistors N6*a*–N7*a* and N6*b*–N7*b*. In some cases, polysilicon lines 510 cross the active areas and form transistors which are not needed for the LSB decode function. The unneeded transistors may be shorted by metal lines that short the source and drain of the unneeded transistors. For example, transistors with gates having the f, f compliment, and e data bit lines are formed in active area 512. However, the desired series transistors N6*b* and N7*b* decode only e and f. Thus, in active area 512 the source and drain on either side of the f compliment data bit line are shorted by metal. Likewise, in active area 513 the desired series transistors N6*a* and N7*b* decode only f compliment and e compliment. Thus, the source and drain on either side of the e data bit line are shorted by metal in active area 513. The remaining active areas 514–519 are similarly programmed.

Reset line 522 is also routed through each cell in polysilicon and forms the gates for reset transistors 434a and 434b. Each cell also has additional circuitry 450. Additional circuitry 450 includes for each decoded word a reset transistor 432, p-channel transistors 414 and 416, a voltage node 412 and n-channel transistor 402 such as shown in FIG. 9E. One embodiment of a layout of this circuitry is shown in FIG. 14, however, other embodiments may also be utilized. As shown in FIG. 14, additional circuitry 450 also includes a ground line 538, power line 540, and reset line 542.

Further modifications and alternative embodiments of this invention will be apparent to those skilled in the art in view of this description. For example, the N-channel and P-channel devices shown herein are generally the preferred arrangement of device types. However, it will be recognized that conceptually the circuitry of the present invention will operate if all N-channel transistors are replaced with P-channel transistors and all P-channels transistors are replaced with N-channel transistors. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size and arrangement and types of components or devices. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A signal driver circuit for driving an LCD panel, said circuit providing analog voltages to LCD panel columns, comprising:

a plurality of data input lines, said plurality of data input lines comprising most signiticant data input lines and least significant data input lines, data on said data input lines digitally representing an analog voltage level to be applied to said LCD panel columns;

a plurality of driver output lines for providing said analog voltages to said LCD panel, a plurality of said data input lines being associated with each said driver output line;

a plurality of decoder cells connected to said plurality of data input lines, each of said decoder cells receiving data from a plurality of said data input lines, said decoder cells comprising:

a plurality of most significant input transistors connected to said most significant data input lines, and a plurality of least significant input transistors connected to said least significant data input lines; and a plurality of switches connected to said plurality of decoder cells for switching one of said analog voltage levels to said driver output lines, wherein at least two of said plurality of decoder cells share said plurality of most significant input transistors.

2. The signal driver circuit of claim 1, wherein said most significant bit transistors and said least significant bit transistors of each of said decoder cells are connected in series.

3. The signal driver circuit of claim 1, wherein said plurality of data input lines comprise a plurality of noninverted data input lines and inverted data input lines.

4. A signal driver circuit for driving an LCD panel, comprising:

a plurality of data input lines, said plurality of data input lines comprising most significant data input lines and least significant data input lines; and a plurality of decoder cells connected to said plurality of data input lines, said decoder cells comprising:

a plurality of most significant input transistors connected to said most significant data input lines, a plurality of least significant input transistors connected to said least significant data input lines, and reset circuitry, wherein at least two of said plurality of decoder cells share said plurality of most significant input transistors.

5. The signal driver circuit of claim 4, wherein at least two of said decoder cells share at least a portion of said reset circuitry.

6. A signal driver circuit for driving an LCD panel, comprising:

a plurality of data input lines, said plurality of data input lines comprising most significant data input lines and least significant data input lines; and a plurality of decoder cells connected to said plurality of data input lines, said decoder cells comprising:

a plurality of most significant input transistors connected to said most significant data input lines, a plurality of least significant input transistors connected to said least significant data input lines, and a voltage level shifting circuit, wherein at least two of said plurality of decoder cells share said plurality of most significant input transistors.

7. A decoder cell within an LCD driver, comprising:

a plurality of data input lines;

a latch circuit connected to said data input lines; and a reset circuit connected to said latch circuit, wherein said latch circuit holds a decoded state of said decoder cell and said reset circuit resets said latch circuit, said latch circuit comprising a plurality of first transistors connected in series, the gates of said first transistors connected to said plurality of input lines.

8. The decoder cell of claim 7, said latch circuit further comprising:

a plurality of second transistors, at least one of said second transistors connected in series with said first transistors and a gate of at least one of said second transistors connected to a node between said series of said first transistors and at least one of said second transistors.

9. The decoder cell of claim 7, comprising:

a plurality of data input lines;

a latch circuit connected to said data input lines; and a reset circuit connected to said latch circuit, wherein said latch circuit holds a decoded state of said decoder cell and said reset circuit resets said latch circuit, said latch circuit comprising, a plurality of first transistors connected in series, the gates of said first transistors connected to said plurality of input lines; and a plurality of second transistors, at least one of said second transistors connected in series with said first transistors and a gate of at least one of said second transistors connected to a node between said series of said first transistors and at least one of said second transistors, wherein said reset circuit comprising:

a first reset transistor, the source and drain of said first reset transistor connected to the respective source and drain of one of said second transistors.

10. A decoder cell within an LCD driver comprising:

a plurality of data input lines;

latch circuit connected to said data input lines; and reset circuit connected to said latch circuit, wherein said latch circuit holds a decoded state of said decoder cell and said reset circuit resets said latch circuit, said latch circuit comprising, a plurality of first transistors connected in series, the gates of said first transistors connected to said plurality of input lines, a plurality of second transistors, at least one of said second transistors connected in series with said first transistors and a gate of at least one of said second transistors connected to a node between said series of said first transistors and at least one of said second transistors, and a third transistor, a gate of said third transistor connected to said node.

11. The decoder cell of claim 10 wherein said plurality of first transistors and said third transistor are the same conductivity type.

12. A decoder cell within an LCD driver comprising:

plurality of data input lines;

a latch circuit connected to said data input lines; and a reset circuit connected to said latch circuit, wherein said latch circuit holds a decoded state of said decoder cell and said reset circuit resets said latch circuit, said latch circuit comprising, a plurality of first transistors connected in series, the gates of said first transistors connected to said plurality of input lines; and a plurality of second transistors, at least one of said second transistors connected in series with said first transistors and a gate of at least one of said second transistors connected to a node between said series of said first transistors and at least one of said second transistors, wherein said reset circuit comprising:

a first reset transistor, the source and drain of said first reset transistor connected to the respective source and drain of one of said second transistors; and a second reset transistor connected in series with said first plurality of transistors and one of said second transistors.

13. The decoder cell of claim 12, further comprising:

a reset signal line connected to a gate of said first reset transistor and a gate of said second reset transistor.

14. A signal driver circuit for driving an LCD panel, comprising:

a plurality of decoder cells each comprising, a plurality of data input lines;

a latch circuit connected to said data input lines; and a reset circuit connected to said latch circuit, wherein said latch circuit holds a decoded state of said decoder cell and said reset circuit resets said latch circuit, said latch circuit comprising, a plurality of first transistors connected in series, the gates of said first transistors connected to said plurality of input lines, said plurality of first transistors comprising most significant bit transistors and least significant bit transistors, wherein at least two of said plurality of decoder cells share at least one most significant bit transistor.

15. The signal driver circuit of claim 14, each of said plurality of decoder cells having respective unshared least significant bit transistors.

16. The signal driver circuit of claim 15, further comprising:

a plurality of second transistors, at least one of said second transistors connected in series with said first transistors and a gate of at least one of said second transistors connected to a node between said series of said first transistors and at least one of said second transistors;

a first reset transistor, the source and drain of said first reset transistor connected to the respective source and drain of one of said second transistors; and a second reset transistor connected in series with said first plurality of transistors and one of said second transistors, at least two of said plurality of decoder cells sharing a common second reset transistor.

17. The signal driver of claim 16, said second reset transistor connected in series between at least two of said first plurality of transistors.

18. A decoder circuit within an LCD signal driver circuit for selecting a decode state corresponding to a voltage to be applied to an output of said signal driver circuit, comprising:

a plurality of generally parallel data bus lines carrying a digital number representing a desired output voltage of said signal driver circuit and extending through said decoder circuit to at least one adjacent decoder circuit, said data bus lines comprising most significant bit data bus lines and least significant bit data bus lines;

a plurality of most significant bit transistors having gates connected to said most significant bit data bus lines, said most significant bit transistors connected to a plurality least significant bit transistors for decoding at least two decode states; and an active area which said gates cross to form an abutting strand of said most significant bit transistors, said active area connected to a plurality of least significant bit transistors.

19. The circuit of claim 18, wherein said least significant bit data bus lines selectively cross said active area to form said least significant bit transistors.

20. The circuit of claim 19 further comprising:

conductors connecting the source and drain of unneeded transistors formed by said least significant bit data bus lines.

21. The circuit of claim 19 wherein said most significant bit data bus lines are routed through said decoder circuit in a first conductor type and connected to said gates by a second conductor type.

* * * * *